US007571828B2

(12) United States Patent
Palley et al.

(10) Patent No.: US 7,571,828 B2
(45) Date of Patent: Aug. 11, 2009

(54) BARRIER UNITS AND ARTICLES MADE THEREFROM

(75) Inventors: Igor Palley, Madison, NJ (US); Gary Allan Harpell, Morristown, NJ (US); Max Wilhelm Gerlach, Hackettstown, NJ (US)

(73) Assignee: DSM IP Assets B.V., Heerlen (NL)

( * ) Notice: Subject to any disclaimer, the term of this patent is extended or adjusted under 35 U.S.C. 154(b) by 153 days.

(21) Appl. No.: 11/497,842

(22) Filed: Aug. 2, 2006

(65) Prior Publication Data

US 2009/0176067 A1 Jul. 9, 2009

Related U.S. Application Data

(63) Continuation of application No. 08/747,471, filed on Nov. 12, 1996, now Pat. No. 7,185,778, which is a continuation-in-part of application No. 08/533,589, filed on Sep. 25, 1995, now Pat. No. 6,991,124.

(51) Int. Cl.
*B65D 1/42* (2006.01)
*B65D 88/14* (2006.01)
*B65D 88/10* (2006.01)

(52) U.S. Cl. ..... 220/1.5; 220/648

(58) Field of Classification Search ..... 220/1.5, 220/4.33, 4.34, 622, 648, 666, 687, 692, 220/646, 650
See application file for complete search history.

(56) References Cited

U.S. PATENT DOCUMENTS 2,946,473 A * 7/1960 Moseley ..... 217/44
3,093,259 A * 6/1963 Morrison ..... 220/592.25
3,111,569 A 11/1963 Rubenstein
3,969,812 A * 7/1976 Beck ..... 29/421.1
4,216,803 A * 8/1980 Hall ..... 138/144
4,623,574 A * 11/1986 Harpell et al. ..... 428/113
5,054,635 A * 10/1991 Kolom ..... 220/4.15
5,249,534 A * 10/1993 Sacks ..... 109/24
5,545,455 A * 8/1996 Prevorsek et al. ..... 428/76

FOREIGN PATENT DOCUMENTS

| | | |
|---|---|---|
| JP | 58-125490 | 7/1986 |
| JP | 4-228344 | 8/1992 |
| JP | 8-26382 | 1/1996 |
| JP | 8-72668 | 3/1996 |

* cited by examiner

*Primary Examiner*—Anthony D Stashick
*Assistant Examiner*—Niki M Eloshway
(74) *Attorney, Agent, or Firm*—Nixon & Vanderhye P.C.

(57) ABSTRACT

Barrier units and articles made therefrom, particularly constraining bands of high strength and low weight for containing articles, especially in blast resistant container assemblies, are disclosed. The barrier unit comprises a surface having a regular polygonal perimeter with a plurality of substantially parallel sides, each of which terminates in at least one loop integral with the surface. The surface comprises at least one network of high strength fiber with at least about 50 weight percent of the fiber comprising substantially contianuous lengths of fiber aligned in the hoop direction of the loops. The barrier units have utility as constraining bands for loads of articles like logs, and as doors/closures for access openings to the interior of aircraft blast resistant cargo containers. They are also useful as fences and window protectors.

13 Claims, 11 Drawing Sheets

BARRIER UNITS AND ARTICLES MADE THEREFROM

RELATED APPLICATIONS

This application is a continuation of application Ser. No. 08/747,471, filed Nov. 12, 1996 now U.S. Pat. No. 7,185,778, which is a continuation-in-part of application Ser. No. 08/533,589, filed Sep. 25, 1995, now U.S. Pat. No. 6,991,124.

BACKGROUND OF THE INVENTION

1. Field of the Invention

The present invention relates to barrier units and to articles made therefrom. More particularly, this invention relates to various constraining bands of high strength and low weight for containing articles such as logs or containers. Most particularly, this invention relates to blast resistant container assemblies for receiving explosive articles and preventing or minimizing damage in the event of an explosion. These container assemblies have utility as containment and transport devices for hazardous materials such as gunpowder and explosives, e.g., bombs and grenades, particularly in aircraft where weight is an important consideration, and more particularly in the cargo holds and passenger cabins of the aircraft. They are also particularly useful to bomb squad personnel in combating terrorist and other threats.

2. The Prior Art

In response to the 1988 terrorist bombing of a Pan American flight over Lockerbie, Scotland, experts in explosives and aircraft-survivability techniques have studied ways to make commercial airliners more resistant to terrorist bombs. One result of these studies has been the development and deployment of new generations of explosive detection devices. As a practical matter, however, there remains a threshold bomb size above which detection is relatively easy but below which an increasing fraction of bombs will go undetected. An undetected bomb likely would find its way into luggage either carried on board (in cabin) by a passenger or stored in an aircraft cargo container. Cargo containers, shaped as cubic boxes with a truncated edge, have typically been made of aluminum, which is lightweight but not explosion-proof. As a consequence, there has been tremendous focus in recent years on redesigning containers to be both blast resistant to bombs that are below this threshold size and lightweight.

A good overview on redesigned aircraft cargo containers is found in Ashley, S., *SAFETY IN THE SKY: Designing Bomb-Resistant Baggage Containers*, Mechanical Engineering, v 114, n 6, June 1992, pp 81-86, hereby incorporated by reference. One type of container disclosed by this article is designed to suppress shock waves and contain exploding fragments while safely bleeding off or venting high pressure gases, while another type is designed to guide explosive products overboard by channeling blast forces out of and away from the airplane hull. Several of the new designs utilize composite materials that are both strong and lightweight. In one such design, a hardened luggage container is wrapped in a blanket woven from low density materials such as SPECTRA® fibers, commercially available from AlliedSignal Inc., and lined with a rigid polyurethane foam and perforated aluminum alloy sheet. A sandwich of this material covers four sides of the container in a seamless shell. In this regard, see also U.S. Pat. No. 5,267,665, hereby incorporated by reference.

Access to a container's interior is necessary for loading and unloading and is typically provided by doors. Doors provide a significant weak point for the container during an explosion since a blast from within the container forces a typical door outward. If the door is connected through a hinge and metal pin arrangement, the pins can become dangerous projectiles. If the door slides in grooves or channels, the grooves or channels may bend or distort to cause failure of the container. It would thus be desirable to have a container design that eliminates the aforesaid problems with doors for access to the container's interior.

U.S. Pat. No. 5,312,182 discloses hardened cargo containers wherein the door engages by sliding in grooves/tracks with an interlock that ostensibly responds to such an explosive blast by gripping tighter to resist rupture of the device. The parent of this case, pending application Ser. No. 08/533,589, filed Sep. 25, 1995, addresses the door closure problem by utilizing at least three nested, mutually reinforcing, perpendicular bands of, preferably, a blast resistant material. Access to the interior of the container is provided by at least partially removing the two outer bands; this has not been found to be a user-friendly solution due to space contraints of the container on an aircraft.

Other blast resistant and/or blast directing containers are described in European Patent Publication 0 572 965 A1 and in U.S. Pat. Nos. 5,376,426; 5,249,534; and 5,170,690. All of these publications are hereby incorporated by reference. Other relevant art is represented by U.S. Pat. Nos. 5,333,532; 5,238,305; 4,809,402; 4,231,135, all hereby incorporated by reference.

The present invention, which was developed to overcome the deficiencies of the prior art, provides barrier units, constraining bands, and blast resistant container assemblies made therefrom.

BRIEF DESCRIPTION OF THE INVENTION

This invention is a barrier unit, for use alone or with other barrier units. The barrier unit comprises a surface having a regular polygonal perimeter, preferably rectangular, with a plurality of substantially parallel sides, each of which terminates in at least one loop integral with the surface. There are preferably a plurality of spaced coaxial loops integral with the surface on each side. The surface comprises at least one network of fiber, preferably in a polymeric matrix, and having a tenacity of at least about 10 g/d and a tensile modulus of at least about 200 g/d. At least about 50, more preferably about 80, weight percent of the fiber comprises substantially continuous lengths of fiber aligned in the hoop direction of the loops. Preferably, a plurality of barrier units are used with one another, connected via their integral loops which function as the knuckles of a hinge through which a connecting pin is inserted.

The present invention is also a constraining band for constraining loads of articles, e.g., steel rods or logs, or for constraining a container assembly to enhance its blast resistance. The constraining band has a length and a width, and comprises at least one network of fiber having a tenacity of at least about 10 g/d and a tensile modulus of at least about 200 g/d, preferably in a resin matrix. At least about 50, more preferably about 80, weight percent of the fiber comprises substantially continuous lengths of fiber along the length of the band. The band is interrupted across its length in at least one place to create two ends, each of which comprises/terminates in at least one integral loop, preferably a plurality of spaced, coaxially aligned loops. A pin is used to connect the loops of the two ends to one another. The pin comprises a rigid or flexible material. Preferred rigid materials are rigid metal and rigid fiber-reinforced composites. Preferred flexible materials comprise fibers in the form of rope, roving unitape, shield, braid, belt (strapping), fabric and combinations thereof. The constraining bands can be made rigid or flexible as desired. If the bands are polygonal in section, they can be made with flexible edges and rigid faces so that they can be collapsed for more efficient storage and transportation for subsequent assembly and use The preferred blast resistant container assembly utilizing the constraining band comprises at least three bands, one of which is the discontinuous/interrupted constraining band which is connected as set forth above to provide strength and energy absorption characteristics comparable to that of uninterrupted bands using continuous fiber. More than one constraining/interrupted band can be used in an assembly; it is preferred, however, that the constraining band be nested at its point or points of connection within a continuous band of material. The assembly also preferably comprises blast mitigating material located within the container.

In a particularly preferred embodiment the blast resistant container assembly comprises a cover, a container, and connecting means. The cover comprises a polygonal perimeter, having first and second substantially parallel sides, each of which terminates in at least one integral loop, preferably a plurality of spaced, coaxially aligned loops. The cover comprises at least one network of high strength fibers having a tenacity of at least about 10 g/d and a tensile modulus of at least about 200 g/d, preferably in a resin matrix. At least about 50, preferably about 80, weight percent of the fiber comprises substantially continuous lengths of fiber that are substantially perpendicular to the first and second sides and aligned in the hoop direction of the loops. The container comprises a wall and an access opening in the wall. The wall comprises at least two integral loops on opposing first and second sides of the access opening. Means is provided for connecting the loop on the first side of the cover with the loop on the first side of the access opening, and means is provided for connecting the loop on the second side of said cover with the loop on the second side of the access opening, with the cover overlaying the access opening. The connecting means can be a single means or a plurality of means. Rigid pins are preferred when a plurality of means is utilized whereas flexible pins are preferred when a single means is utilized. It is preferred that the perimeter shape be that of a regular polygon; as long as opposing parallel sides of the cover are the same length, even though the length may differ from that of other opposed pairs within the cover, then the polygon is deemed to be regular. The preferred shape is a rectangle wherein the third and fourth sides of the cover each terminate in at least one loop and wherein the wall further comprises at least an additional two integral loops on opposing third and fourth sides of the access opening. Means is provided for connecting the loop on the third side of the cover with the loop on the third side of the access opening, and means is also provided for connecting the loop on the fourth side of the cover with the loop on the fourth side of the access opening.

The present invention also comprises an improvement in a hinge comprised of a pair of hinge halves terminating in coaxially aligned knuckles for connection with one another by a rigid pin. The improvement comprises a connecting pin comprising a flexible material selected from the group consisting of rope, roving, unitape, shield, braid, belt, fabric and combinations thereof.

In an alternate embodiment, the present invention is an improved container assembly comprising a container having a wall and an access opening in the wall. The improvement comprises a hinge formed of fibrous material. The hinge comprises a pair of hinge halves terminating in spaced, coaxially aligned knuckles which are joined together by a pin to cover the access opening. A portion of each of the hinge halves is integral with and covers a portion of the container wall.

BRIEF DESCRIPTION OF THE DRAWINGS

The invention will be more fully understood and further advantages will become apparent when reference is made to the following drawing figures and the accompanying description of the preferred embodiments wherein.

DETAILED DESCRIPTION OF THE INVENTION

Figure 1:
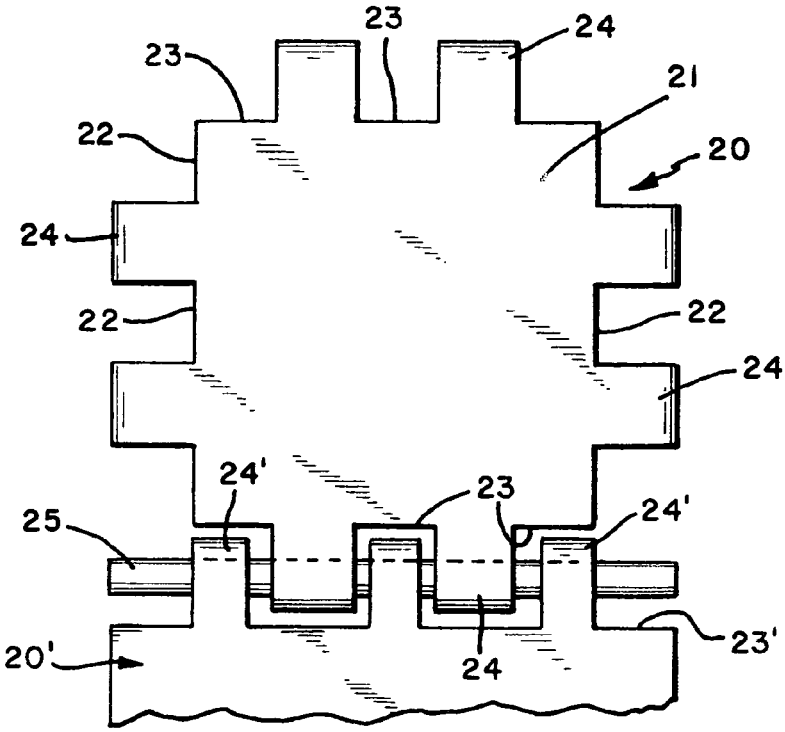
FIG. 1 is a plan view of a barrier unit 20 of the present invention, connected via pin 25 to another barrier unit 20'.

The preferred invention will be better understood by those of skill in the art with reference to the above figures. The preferred embodiments of this invention illustrated in the figures are not intended to be exhaustive or to limit the invention to the precise form disclosed. It is chosen to describe or to best explain the principles of the invention and its application and practical use to thereby enable others skilled in the art to best utilize the invention. In particular, the bands of blast resistant material are shown in the accompanying drawings with parallel lines representing substantially continuous fibers/filaments in the hoop direction of the bands, i.e., as unidirectional fibrous bands. This representation is for ease in understanding the invention—while it constitutes one fabric contemplated for use in the present invention, it is not the exclusive fabric.

Initial discussion of the drawing figures will be directed to design considerations followed by a discussion of appropriate materials and how they affect blast resistance andor blast-directing capabilities of the structures.

Referring to FIG. 1, barrier unit 20 comprises a surface 21 having a regular polygonal perimeter, i.e., essentially a square, with a plurality of pairs of substantially parallel sides 22 and 23. Each of parallel sides 22 and 23 terminates in at least one loop 24 integral with surface 21, in this instance 2 loops 24 per side 22, 23. In FIG. 1, barrier unit 20 is shown affixed to another, similar varrier unit 20' via pin 25. Pin 25 may be rigid or flexible (soft), according to end use and desired properties.

This barrier unit 20 of FIG. 1 can be used to close a blast resistant container (see FIG. 13 and accompanying discussion), or as a window protector if affixed in front of a conventional window with pins into a mating sill. Such a protector would provide protection against thrown missiles, bullets, hurricanes and so forth. The connecting pins/rods could be locked into place with stops (not shown).

Figure 2:
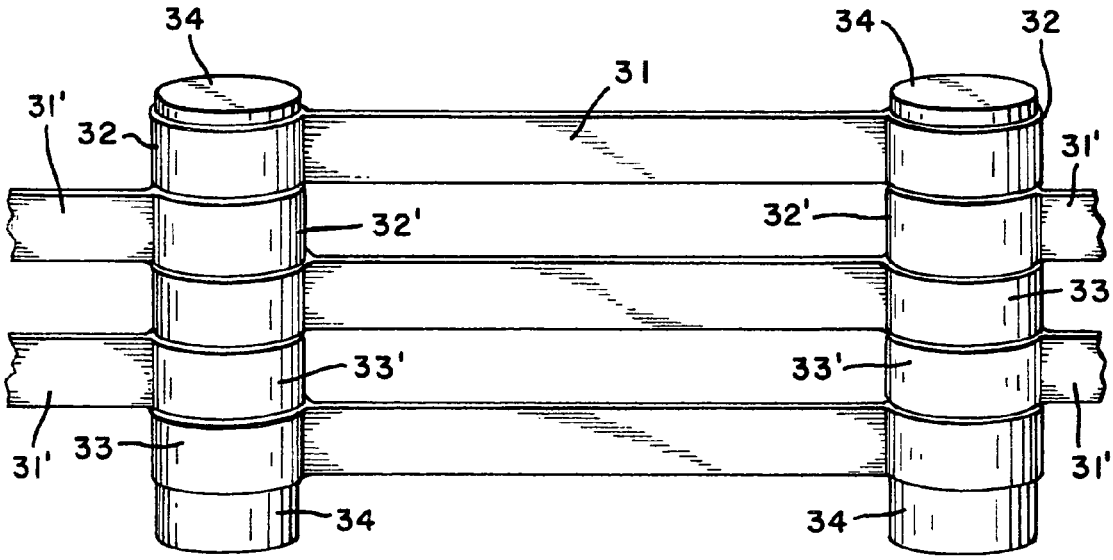
FIG. 2 is a three dimensional view of constraining bands 31 and 31', used with posts 32 to form a fence 30.

With reference to FIG. 2, a fence/barrier 30 is shown. Fence 30 comprises a plurality of constraining bands 31 and 31' which can be used to confine animals or to provide protection against a wide variety of threats, including vehicles, avalanches, and trespassing snowmobiles, etc. Bands 31 and 31' have a length and a width. Bands 31 and 31' are interrupted across the length thereof to create two ends 32 and 32', respectively. Ends 32 and 32' comprise at least one integral loop 33 and 33', respectively. In FIG. 2, each end comprises only one integral loop 33 or 33'. Fence 30 is formed by connecting the loops 33 and 33' with a pin 34, depicted as a post. In this instance, pin 34 would desirably be formed of a rigid material, e.g., wood.

Figure 3A:
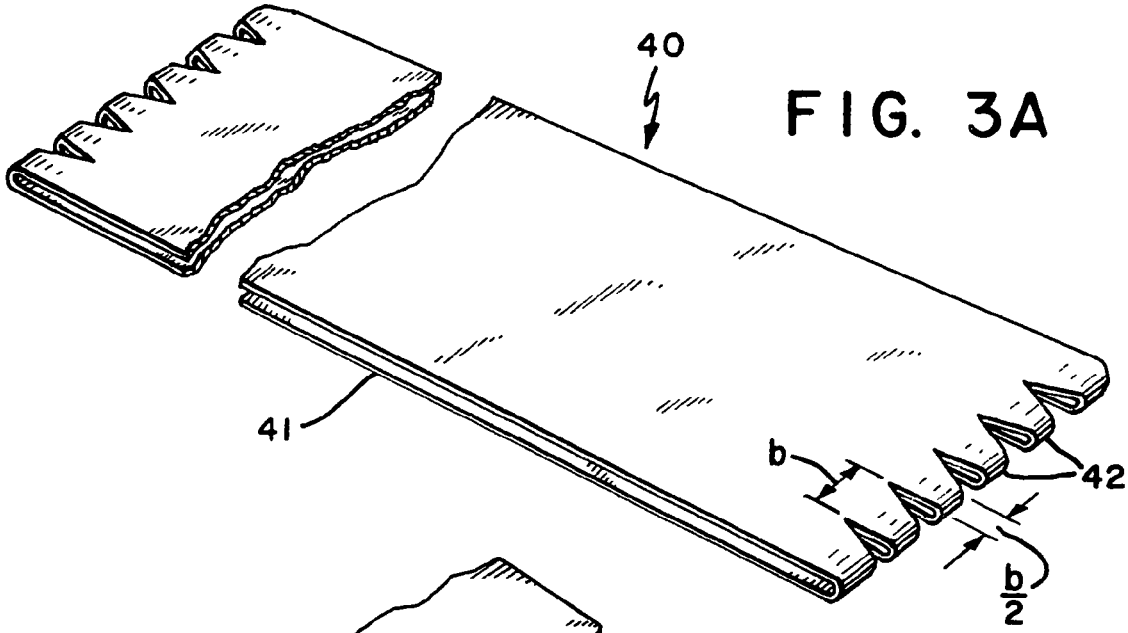
FIG. 3A is a three dimensional view of constraining band 40.
Figure 3B:
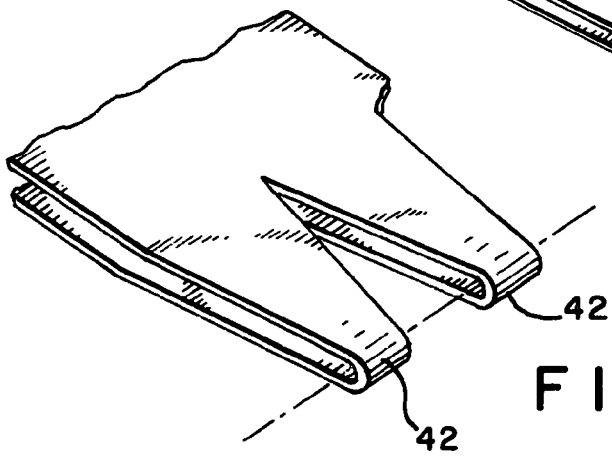
FIG. 3B is an enlarged three dimensional partial view of loops 41 forming part of band 40.
Figure 3C:
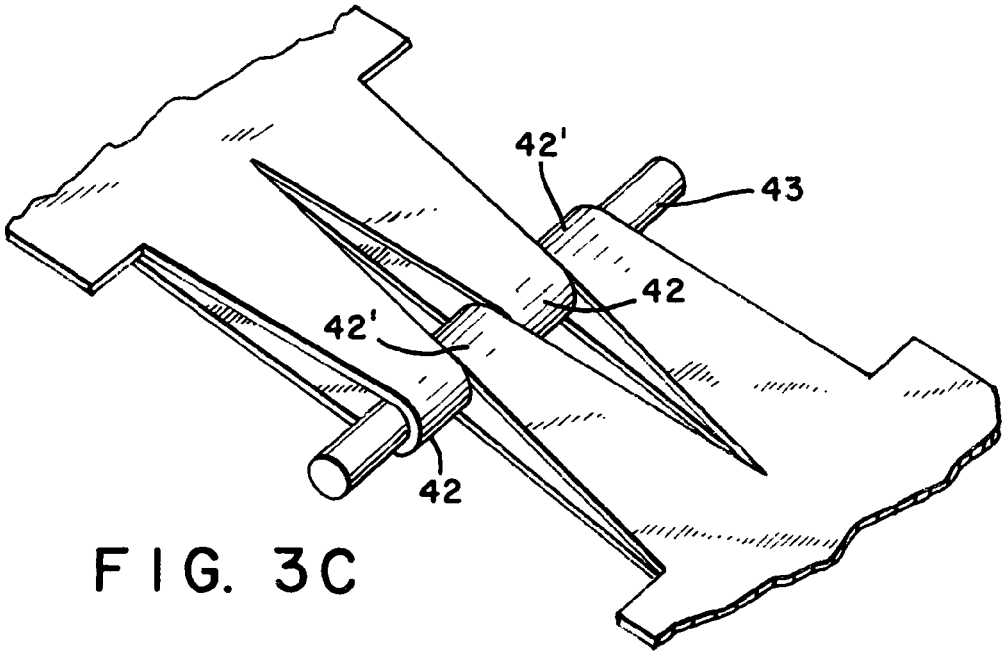
FIG. 3C is an enlarged three dimensional partial view of loops 41 and 41' connected with one another.
Figure 3D:
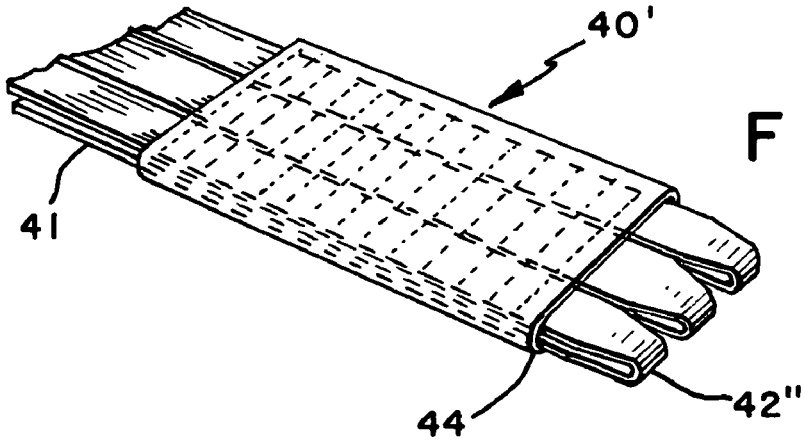
FIG. 3D is a three dimensional view of an alternate constraining band 40'.

With reference to FIGS. 3A-3D, formation of an interrupted constraining band 40 is shown. Unitape or other fabric may be used to create such an interrupted band 40. A belt 41 of unitape is created by winding a length of same around two rods (not shown) separated by an appropriate distance. The big fabric wraps at either end are separated into a number of segments of width b. The yarn is pushed together to produce loops 42 of width b/2 (see FIG. 3B). It is desirable that all of the fibers be continuous across loops 42 as depicted. The band may be constructed from a variety of materials, including rope, roving, unitape, shield, braid, belt (strapping), fabric, and combinations thereof. Details on unitape and shield may be found in the accompanying examples of the invention. Pin 43 can be used to connect interleaved, coaxially aligned loops 42 and 42'. Pin 43 may be formed of rigid or flexible (soft) material, as desired. In FIG. 3D, is shown an alternate interrupted band 40' wherein fabric 41, preferably unitape, forms several discrete sub-bands which are reinforced across the main body thereof, i.e., that portion exclusive of loops 42", with fabric 44, preferably having continuous length fiber normal to that of the unitape, sewn thereto.

Figure 4:
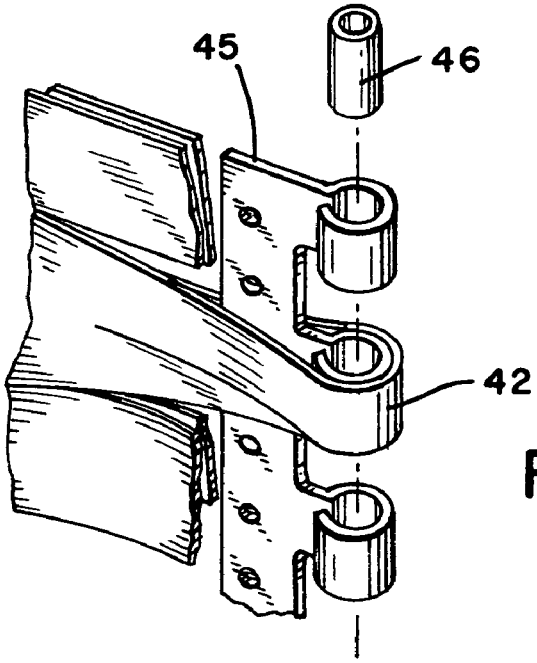
FIG. 4 is a partial three dimensional view of loops 42 reinforced with hinge half 45 and tubes 46.
Figure 5:
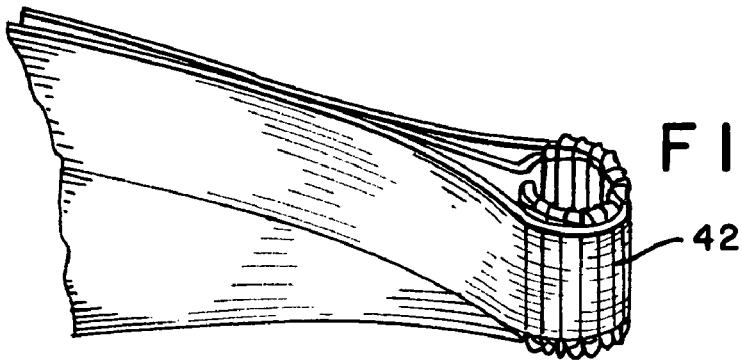
FIG. 5 is a partial three dimensional view of alternate, consolidated loops 42.

With reference to FIG. 4, an actual hinge half 45 with short tubes/inserts 46, may be inserted within the loops 42 to provide rigidity. These tubes may be formed from plastic, metal, ceramic, composites or wood. All of the tubes on each end of the band preferably are linked together to create a hinge system which will keep the openings in register and allow a pin 43 to be easily inserted or removed to close or open the band. The tubes, or hinge knuckles, may be circular or oblong in cross-section. FIG. 5 depicts another way to form rigid loops 42 wherein the wrapped material is consolidated to form loops 42.

Figure 6:
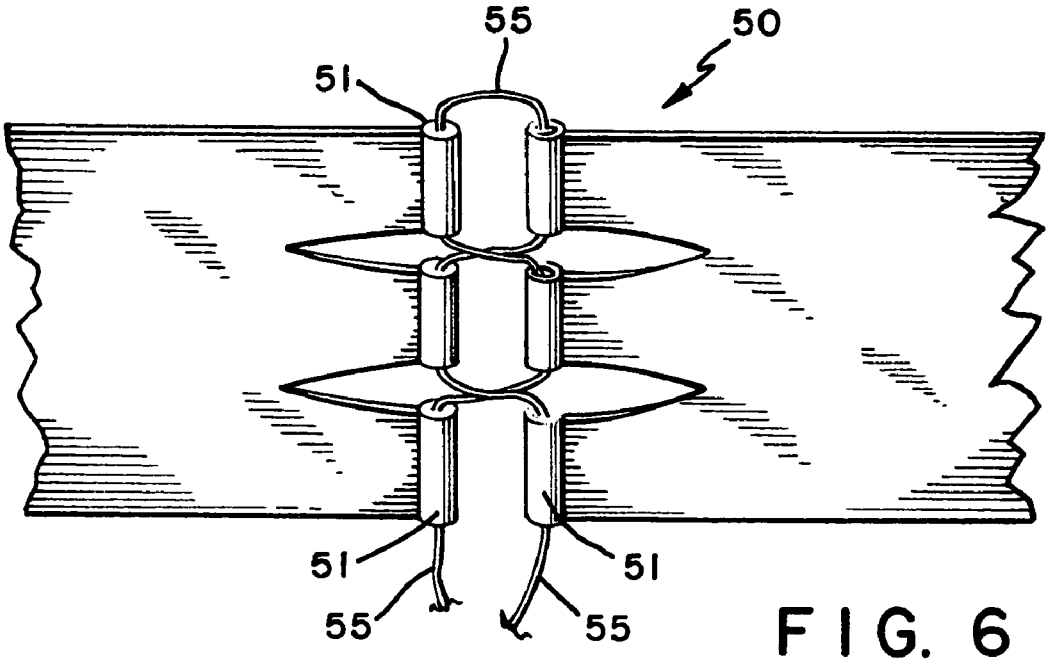
FIG. 6 is a side view of constraining bands 50 of the present invention utilizing a soft/flexible pin 55 to connect loops 51.
Figure 7:
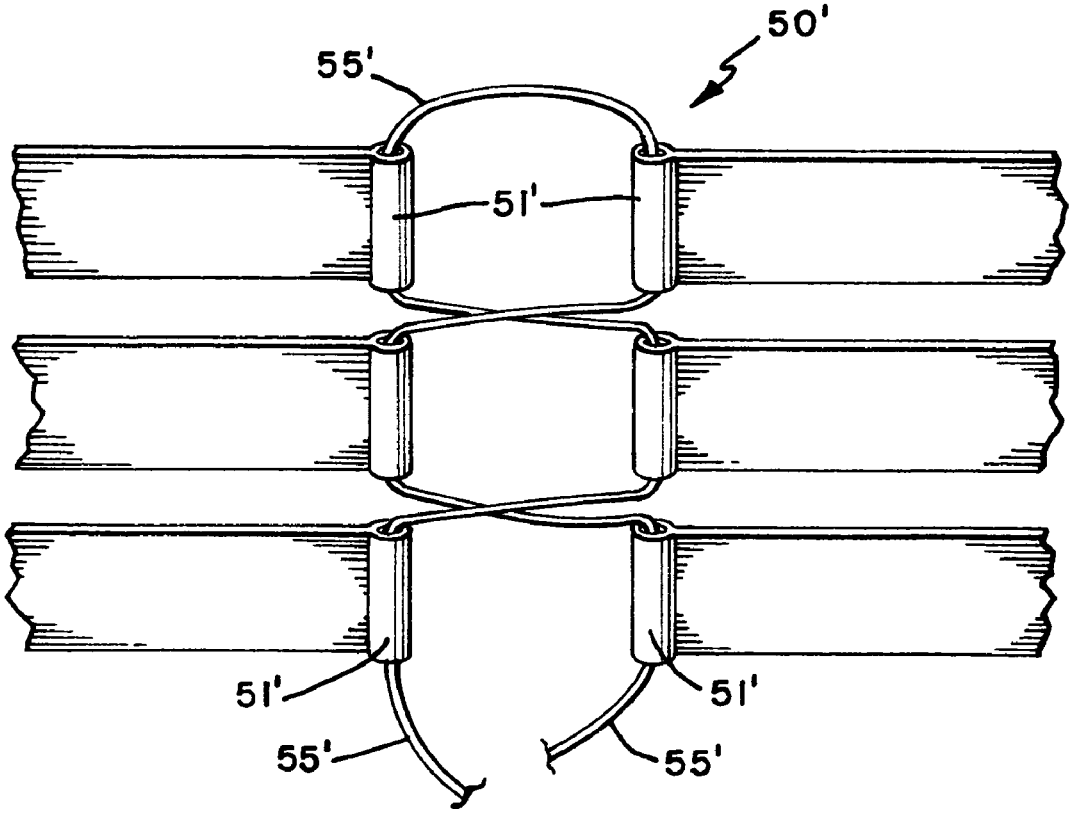
FIG. 7 is a side view of a plurality of constraining bands 50' of the present invention, also utilizing a soft/flexible pin 55' to connect loops 51'.

With reference to FIGS. 6 and 7, the interrupted band 50, 50' can be closed by lacing it up with a strong flexible material, such as soft pin 51, 51', respectively. In this case the loops 51 can be coaxially aligned per end and adjacent the loops of the other end for lacing, e.g., like a shoelace. FIGS. 6 and 7 differ from one another in that the interrupted band 50' of FIG. 7 actually comprises a plurality of discrete sub-bands wherein each sub-band end terminates in a single loop. In both instances, the loops can be in register, or not, as desired, and can cover anywhere from about 20 to about 95% of the band. The closure of the band may leave little distance between the mating ends/edges, as in FIG. 6, or may leave a considerable distance, as in FIG. 7, all according to end use. Appropriate strong knots, sockets, and/or stops (not shown) can be used to effect closure. Optionally, yokes or flanges (not shown) can be used to keep loops in appropriate register.

Figure 8A:
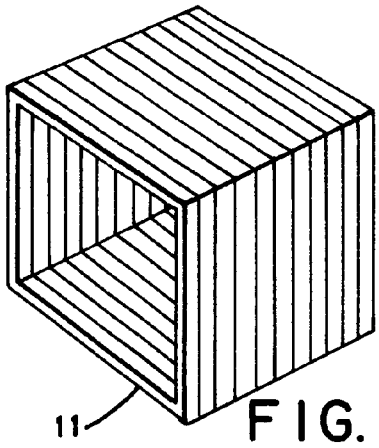
FIG. 8A is a three dimensional view of band 11 which forms part of container assembly 10 of FIG. 8F.
Figure 8B:
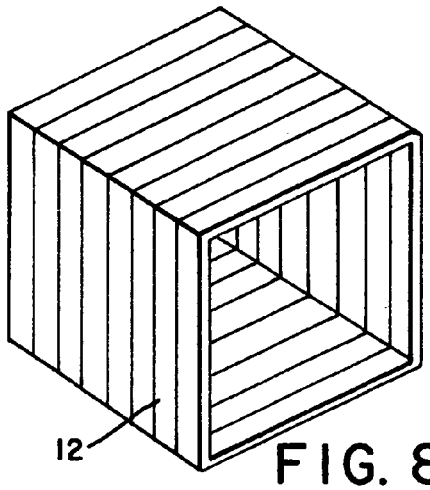
FIG. 8B is a three dimensional view of band 12 which forms part of container assembly 10 of FIG. 8F.
Figure 8C:
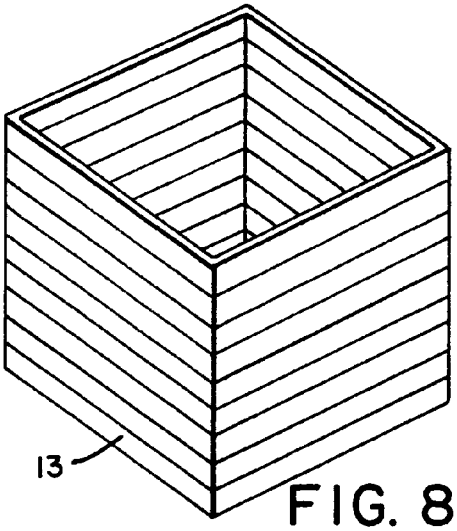
FIG. 8C is a three dimensional view of band 13 which forms part of container assembly 10 of FIG. 8F.
Figure 8D:
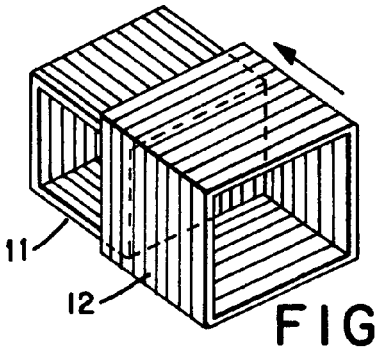
FIG. 8D is a three dimensional partial assembly view which together with FIG. 8E illustrates the assembly sequence for container assembly 10.
Figure 8E:
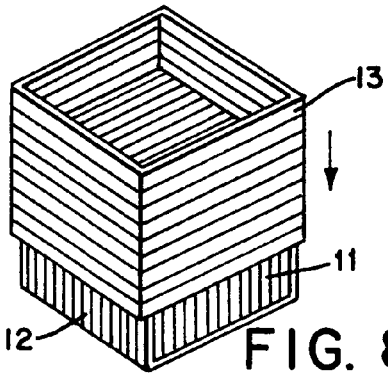
FIG. 8E is a three dimensional partial assembly view which together with FIG. 8D illustrates the assembly sequence for container assembly 10.
Figure 8F:
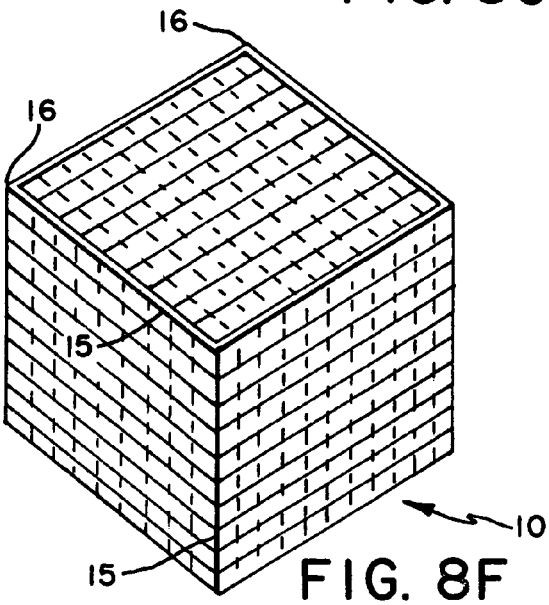
FIG. 8F is a three dimensional assembly view of container assembly 10.
Figure 8G:
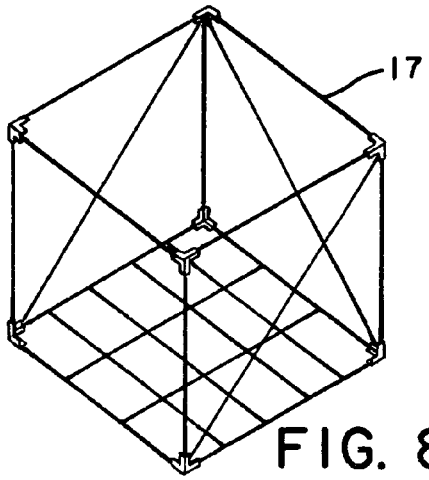
FIG. 8G is a three dimensional view of an optional support structure for use with any of the container assemblies 10 depicted.

Referring to FIG. 8F, the numeral 10 indicates a blast resistant container assembly. The container comprises a set of at least three nested and mutually reinforcing four-sided continuous bands of material 11, 12, and 13 assembled into a cube. See FIGS. 8A, 8B, and 8C. By "band" is meant a thin, flat, volume-encircling strip. The cross-section of the encircled volume may vary, although polygonal is preferred to circular, with rectangular being more preferred and square being most preferred, as depicted. With reference to FIGS. 8D and 8E, a first inner band 11 may be filled with blast mitigating material (e.g., an aqueous foam) and then nested within a slightly larger second band 12 which is nested within a slightly larger third band 13, all bands with their respective longitudinal axes perpendicular to one another. In this fashion, each of the six panels forming the faces of the cubic container will have a thickness substantially equivalent to the sum of the thicknesses of at least two of the bands 11, 12 and 13, where they overlap, and every edge 15 of the container is covered by at least one band of material, 11, 12, or 13. Stated differently, after the load (explosive or luggage) is placed in the first band 11, blast mitigating material (not shown) is optionally placed or dispersed around the load within the first band 11. The second structurally similar band 12 of slightly larger dimensions is placed over the first so that its longitudinal axis is perpendicular to that of first band 11 (see FIG. 8D). The third, similar yet larger, band 13 is slid over the second band 12, so that its longitudinal axis is perpendicular to the axes of both bands 11 and 12 (see FIG. 8E). The third band 13 completes the blast resistant container assembly 10. The fit between bands 11, 12 and 13 is not intended to be a gastight seal, but is a close fit to permit gas to vent gradually, in the event of an explosion, from the corners 16 of the cubic container. It is preferred that the bands slide on one another, and therefore the frictional characteristics of their surfaces may need to be modified, as will be discussed in more detail later. Container assembly 10 does not have a separate entry door and thus avoids all of the limitations presented by the same in the prior art. FIG. 8G depicts a weight/load bearing frame 17 which may optionally be nested within container assembly 10 in the event that container assembly 10 is insufficiently rigid for bearing the items to be loaded therein. Inner band 11 is slipped over the frame initially, and then assembly proceeds as earlier discussed. Frame 17 may be made from metal, wood or structural composite rods designed in a way to optimize the load bearing capacity of the structure and to minimize container weight.

As previously stated, however, assembly 10 requires movement of the bands to operate which is not always user friendly, especially when there are space constraints as with aircraft. The interrupted band of the present invention is designed to be mechanically closed so as to provide strength and energy absorption characteristics similar to that of uninterrupted/continuous bands using continuous fiber. The interrupted band may be used to contain blast, either alone or in conjunction with other bands, continuous or interrupted. The interrupted band may be used in conjunction with a conventional blast resistant container, possibly steel if weight is not a concern, to provide a closure system. Such bands may also be used for a variety of other applications, such as constraining loads of steel rods or logs on a truck bed, for instance. These bands can be closed with rigid and/or flexible pins, discussed in further detail later.

Figure 9:
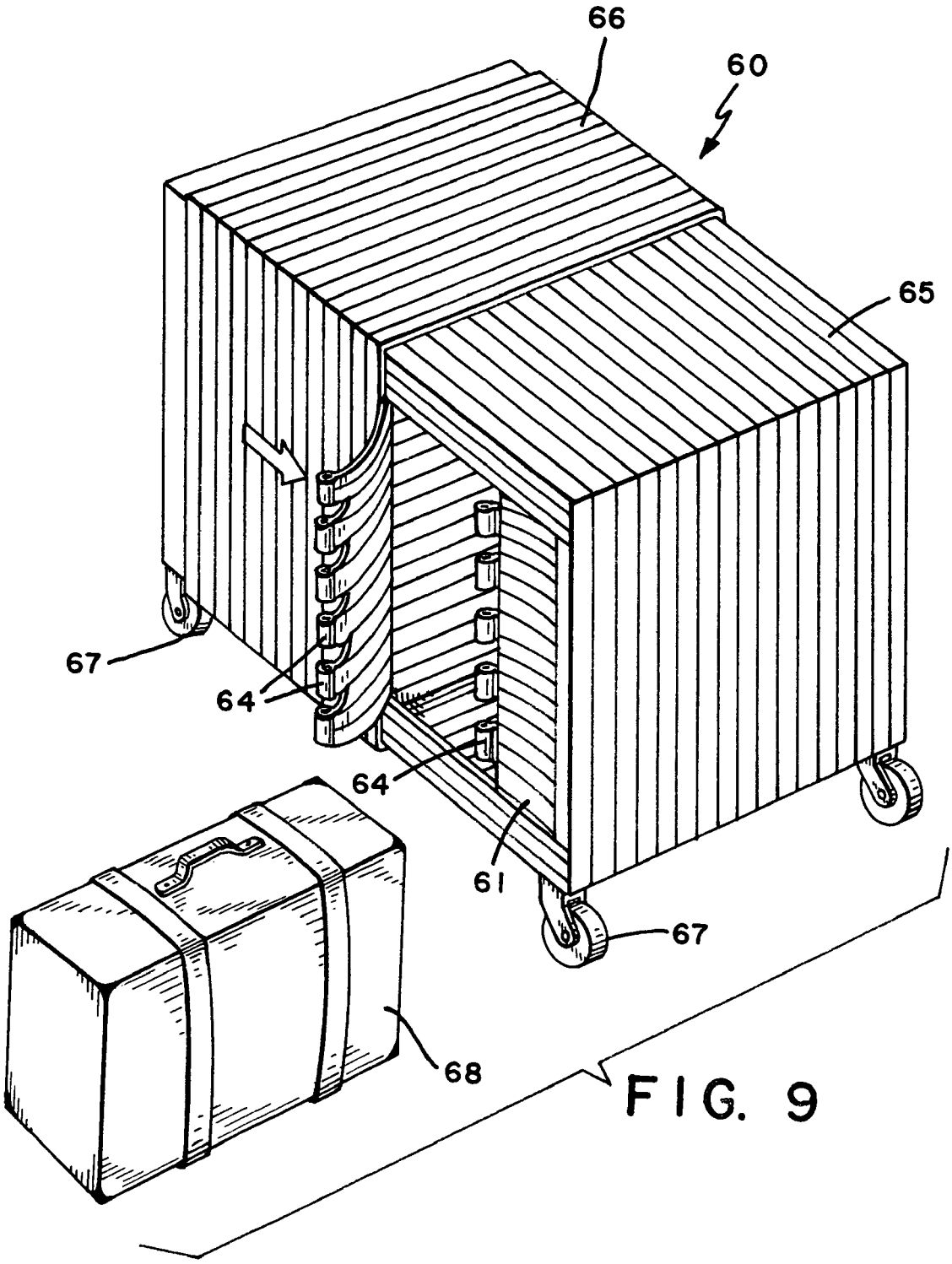
FIG. 9 is a three dimensional view of an in-airport container assembly 60 for containing and transporting luggage 69 containing an explosive.

With regard to FIG. 9, in-airport blast resistant container assembly 60 is depicted. Luggage 68 containing an explosive is detected by a device (not shown) used by airport security personnel. It is placed inside container assembly 60 and taken to a place where the explosive can be safely removed or detonated. A rigid rectangular shell prism (not shown) is formed with one face missing. A first band 61 is formed and interrupted across the length thereof. Loops 64 are formed at the two ends of first band 61, which is wrapped around the shell so as to center the band interruption on the access opening of the shell. Second, continuous band 65 of slightly larger dimensions is placed over closed first band 61 so that its longitudinal axis is perpendicular to that of first band 61. The third, continuous and yet larger, band 66 is slid over the second band 65, so that its longitudinal axis is perpendicular to the axes of both bands 61 and 65. Casters 67 can be attached to the base of the assembly 60 for mobility. In use, band 66 is slid to one side of assembly 60 to expose band 61 which is mechanically closed thereacross by connection of loops 64. Loops 64 are disconnected to open band 61. Luggage 68 is placed within assembly 66, and thereafter, blast mitigating material is optionally is placed or dispersed around the load within first band 61. Second band 65 is either slid onto first band 61 or is permanently affixed with the orientation as shown in FIG. 9. Third band 66 is then rolled horizontally to cover the mechanically closed, interrupted band 61.

With reference to FIGS. 10A-10E, a hardened aircraft luggage container assembly 70 of the LD3 type is shown. The container is a rectangular box with a step 76 created at the bottom of one side to facilitate band wrapping. The box was constructed as detailed in Example 2 set forth below. The structural shell had an access opening 80 to the interior thereof on the front side. The blast containment function is primarily provided by three mutually reinforcing, perpendicular bands 72, 78, and 79 (two continuous bands 78 and 79 forming the middle and outer bands, respectively, and one interrupted/discontinuous band 72 having a pin joint and forming the inner band along with sub-bands 71). The interrupted band 72 overlaps the side edges of access opening 80 slightly. The hinge connection is created by subdividing band 72 into a plurality of parts which are used to form loops/knuckles 81, 81' which are spaced and coaxially aligned on each end of band 72. The loops 81 and 81' are aligned as in a hinge for connecting pin 82 to be placed therethrough.

Figure 10A:
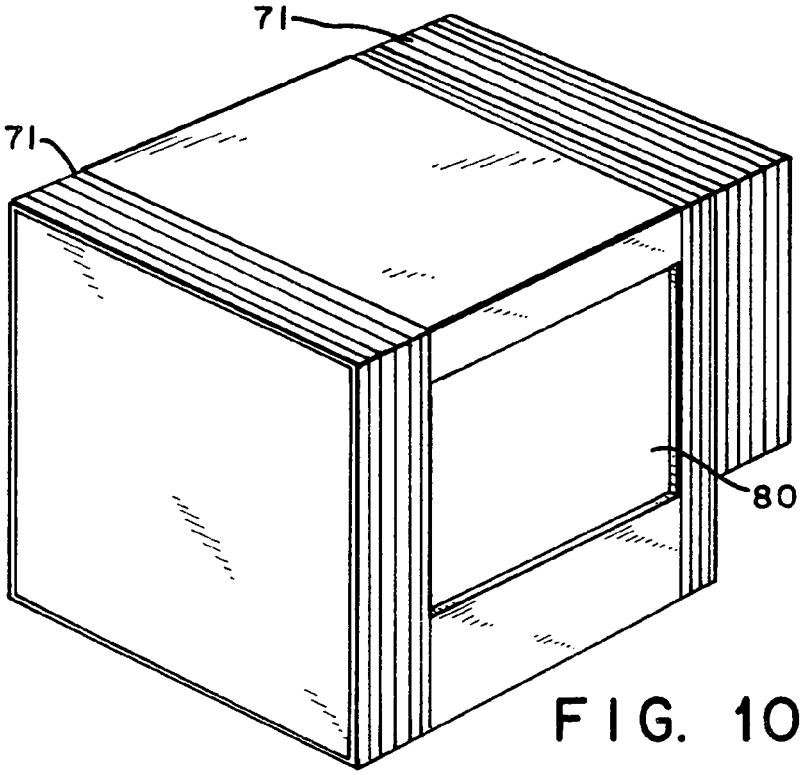
FIG. 10A is a three dimensional view of sub-bands 71 which form part of container assembly 70 of FIG. 10E.
Figure 10B:
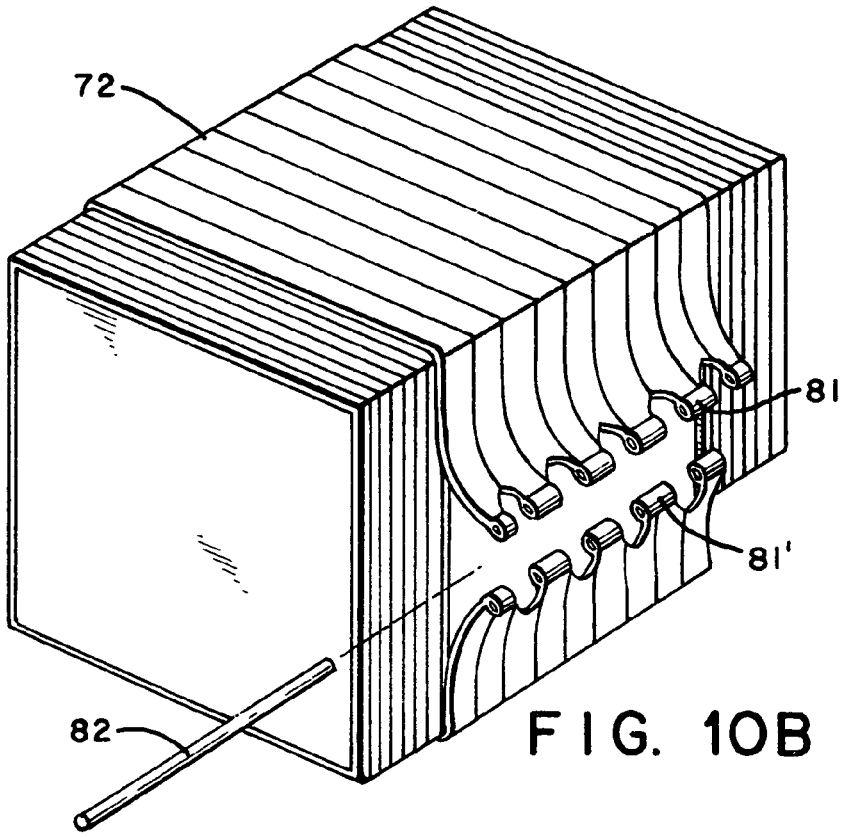
FIG. 10B is a three dimensional view of partially assembled container assembly 70 with interrupted band 72 wrapped in place.
Figure 10C:
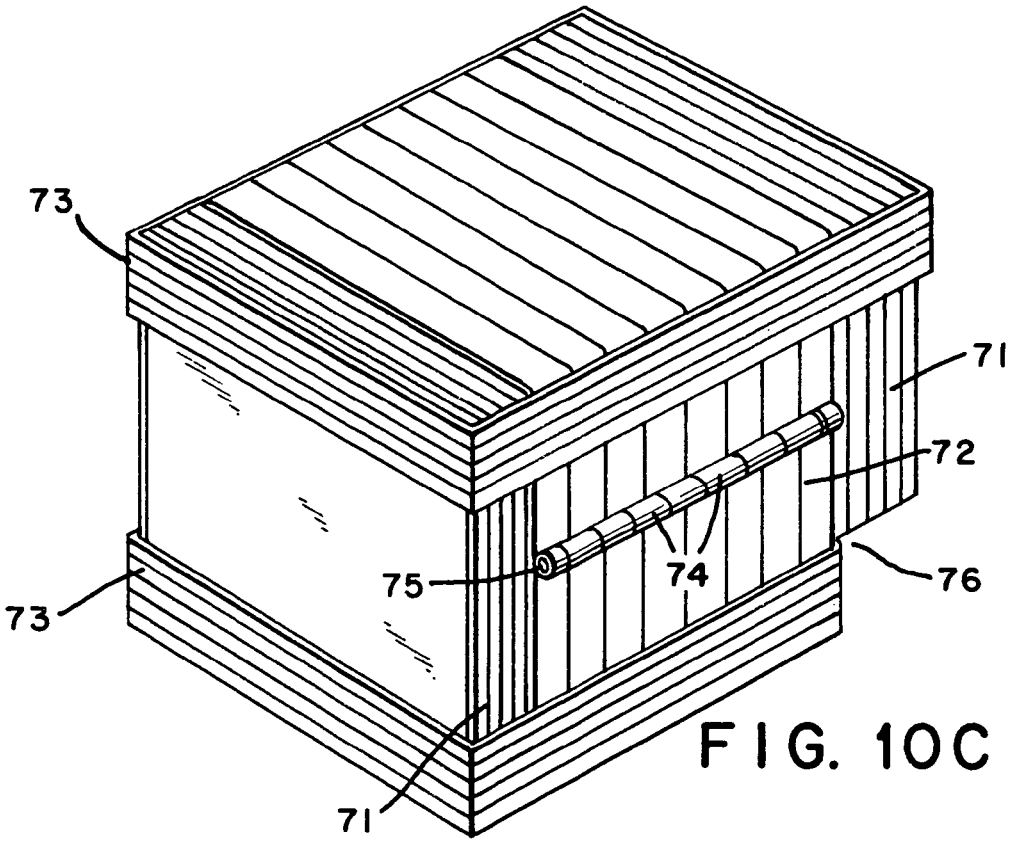
FIG. 10C is a three dimensional view of partially assembled container assembly 70 with sub-bands 73 in place.
Figure 10D:
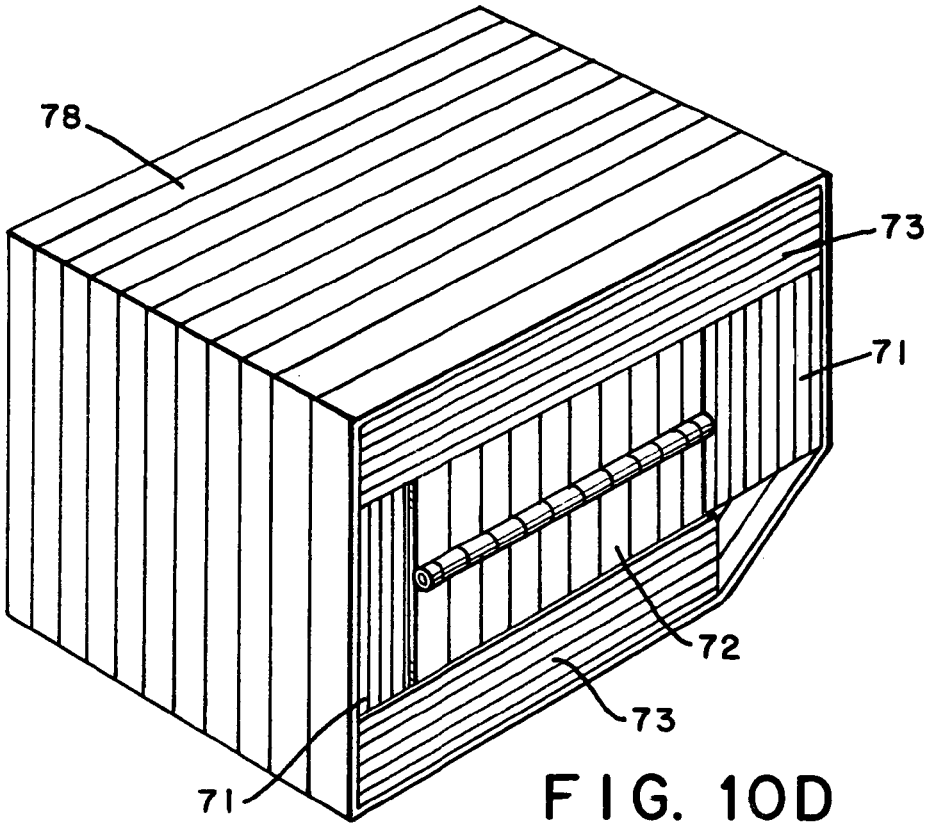
FIG. 10D is a three dimensional view of partially assembled container assembly 70 with band 78 in place.
Figure 10E:
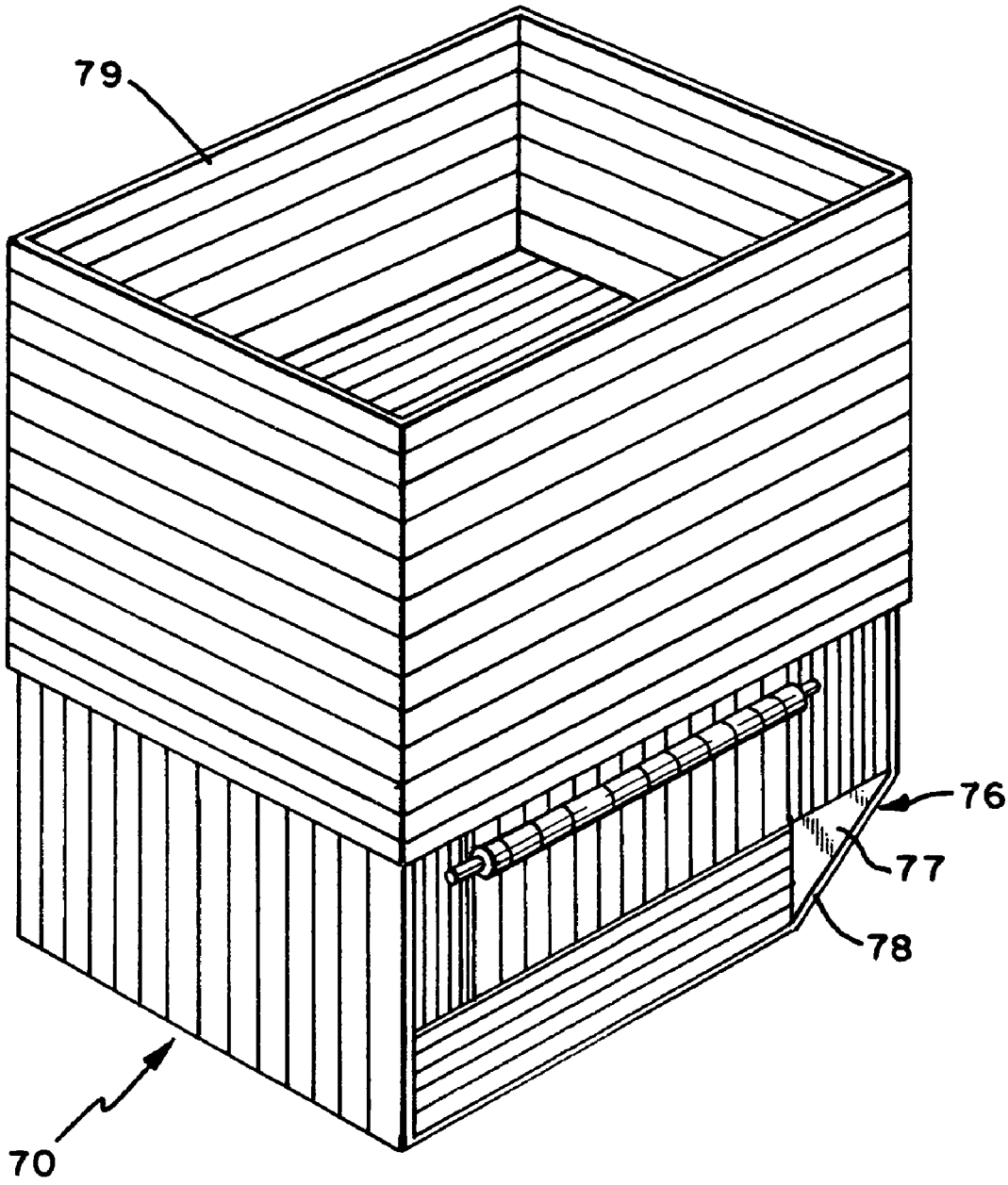
FIG. 10E is a three dimensional assembled view of container assembly 70 with third band 70 oriented for closure of container assembly 70 with step 77 in place.

With reference to FIGS. 10A and 10C, it can be seen that continuous sub-bands, narrower in width than the box, are wound to either side of access opening 80 in a front, top, back, bottom orientation (see FIG. 10A), after which the interrupted inner band 72 is placed over the box with pin 82 connecting ends across the middle of access opening 80. The pin is horizontal in orientation. Two additional continuous sub-bands 73, similar to the others, are formed on the box on either side of access opening 80 in a front, side, back, side orientation (see FIG. 10C). These sub-bands 73 are permanently attached to the box. A triangular wedge 77 is placed in step 76 with its base located to the exterior prior to wrapping of middle band 78. This wedge, in conjunction with the stepped box, forms the truncated side of the aircraft LD3 container 70. Middle band 78 is permanently attached to the box since it does not interfere with the opening of the box. Outer band 79 is a removable band, placed on assembly 70 perpendicular to the other primary bands 72 and 78.

Figure 11A:
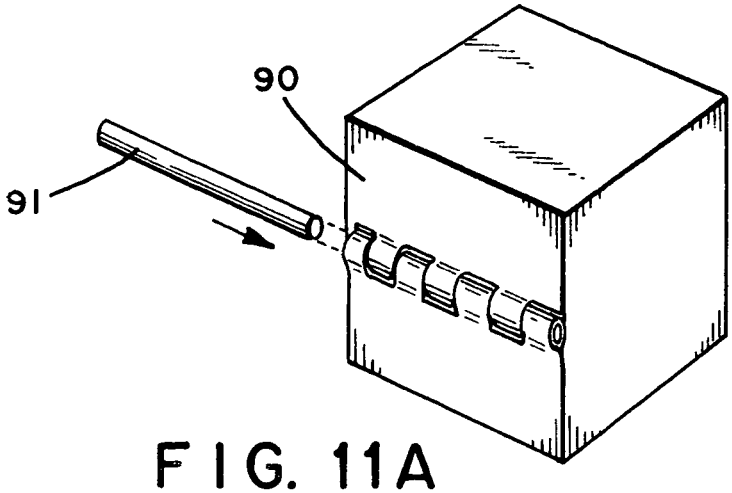
FIG. 11A is a three dimensional view of a container with interrupted band 90 thereon with a rigid pin 91 for mechanical closure.
Figure 11B:
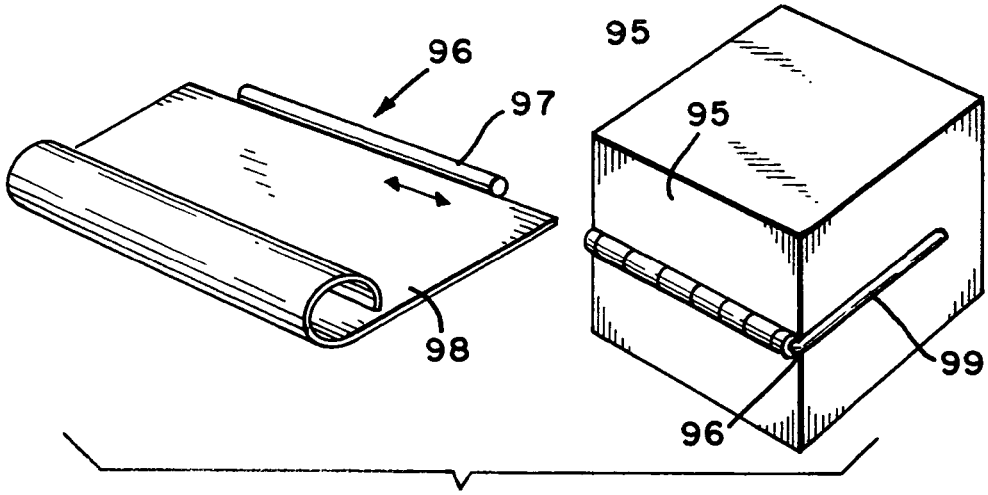
FIG. 11B is a three dimensional view of a container with interrupted band 95 thereon with a rigid composite pin 96 for mechanical closure.
Figure 11C:
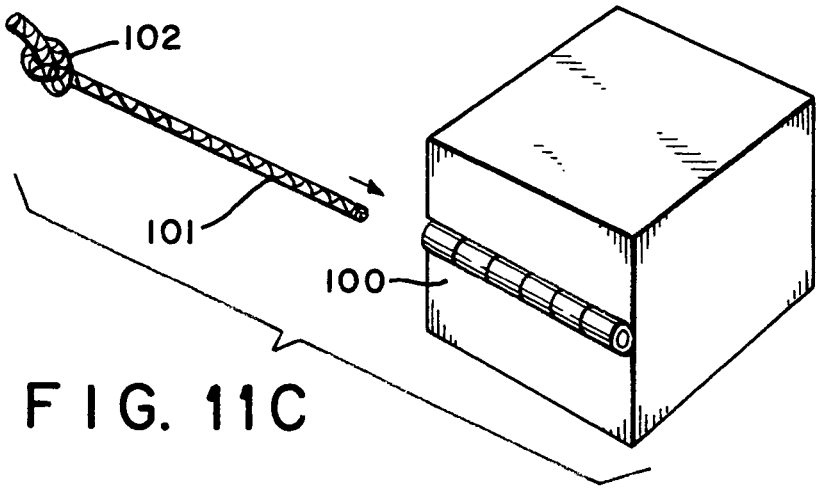
FIG. 11C is a three dimensional view of a container with interrupted band 100 thereon with a flexible rope 101 for mechanical closure.

FIG. 11A depicts a partially assembled container with interrupted band 90 thereon with a rigid pin 91 for mechanical closure. FIG. 11B shows a partially assembled container with interrupted band 95 thereon with a rigid composite pin 96 for mechanical closure. Composite pin 96 is formed by wrapping a fibrous composite layer 98 around a rigid pin 97. Pin 96 is then threaded through the loops of interrupted band 90 with its tails 99 folded to either side for closure by yet another band of material (not shown). FIG. 11C shows a partially assembled container with interrupted band 100 thereon with a flexible rope 101 for mechanical closure. Rope 101 is knotted at one end 102 to keep it from sliding through the loops of the interrupted band 100.

Figure 12:
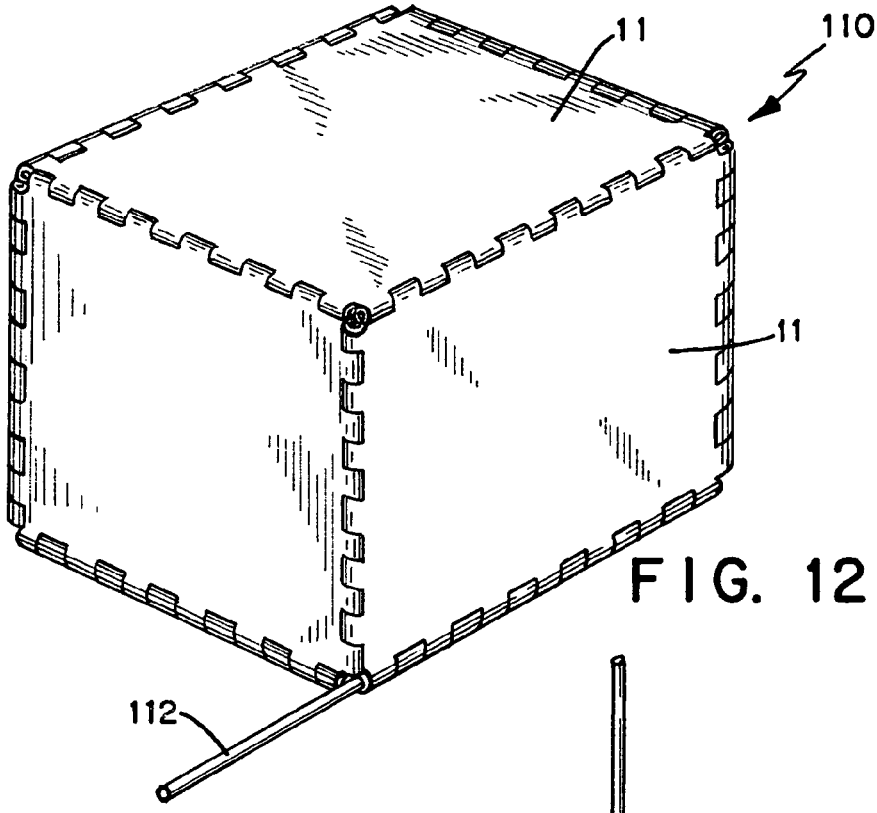
FIG. 12 is a three dimensional view of a container 110 formed from six separate panels/barrier units 111 connected with twelve pins 112 at its edges.
Figure 13:
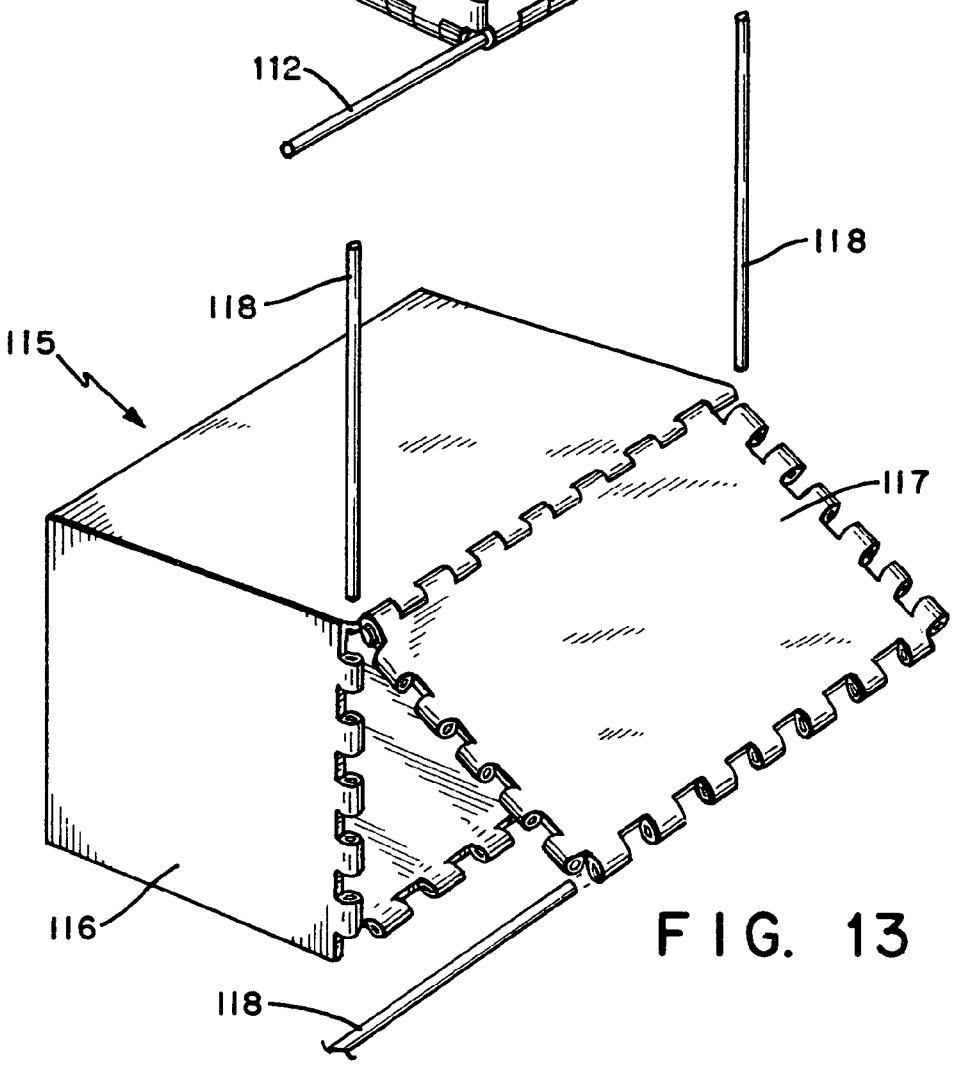
FIG. 13 is a three dimensional view of a container 115 formed from a five-sided box 116 having a removable door 117 located with four pins 118.

FIG. 12 shows a container 110 formed from six separate panels/barrier units 111 connected with twelve pins 112 at its edges. FIG. 13 shows a container 115 formed from a five-sided box 116 having a removable door 117 located with four pins 118.

Many differing container shapes are contemplated by the present invention. For instance, the container assembly of FIG. 10E encloses a non-cubic rectangular prism due to the differing rectangular cross-sections of its three bands. The preference for the bands to have a polygonal cross-section is derived from the tendency for the container to deform to increase the internal volume during an explosion. A regular polygon is preferred, more preferably a rectangle, and most preferably a square. It is desirable to have opposed parallel sides of substantially equal length although it is not necessary that all sets of opposed parallel sides in the regular polygon be of substantially equal length, i.e., with a rectangular surface, a set of opposed sides can be longer than the other set of opposed sides, as long as the surface is not a square.

It should be appreciated by now that substantially more than three bands can readily be utilized in the present invention, even with the basic cube (or rectangular prism) design of the container. Theoretically an unlimited number of coaxial bands can be used in parallel, preferably abutting one another, to substitute for any one band in the basic three-band container concept of the invention. It is preferred, however, that the outermost band comprises a single continuous band. Furthermore, a large number of coaxial bands can also be coaxially nested one within the other to substitute for any one band in the basic three band container concept of the invention; the number of bands utilized as an equivalent may depend upon the desired rigidity of the equivalent. It is possible to have several flexible bands which, when nested coaxially, become rigid.

In the various embodiments depicted, a rigid inner liner or band can be constructed using one or more of the techniques and/or material to follow. The inner liner/band may be rotationally molded using polyethylene, cross-linkable polyethylene, nylon 6, or nylon 6,6 powders. Technology described in *Plastics World*, p. 60, July, 1995, hereby incorporated by reference, can also be used. Tubes, rods and connectors may be used, preferably formed from thermoplastic or thermoset resins, optionally fiber reinforced, or low density metals such as aluminum. The inner liner/band may utilize a continuous four-sided metal band. Sandwich constructions consisting of honeycomb, balsa wood or foam core with rigid facings may be used. The honeycomb may be constructed from aluminum, cellulose products, or aramide polymer. Weight can be minimized by using construction techniques well known in the aerospace industry. (Carbon fiber reinforced epoxy composites may be used.) A rigid inner shell/band can be constructed from wood using techniques well known to the carpentry trades. (Flame retardant paints may usefully be used.) The rigid inner liner/band may serve as a mandrel onto which the bands are wound and can form part of the final blast container. Alternatively the inner liner can be inserted into the inner band after the band has been constructed.

As used herein with respect to bands, "rigid" means that a band is inflexible across the face or faces thereof. If the band comprises a plurality of faces and edges, then it may be substantially inflexible across the faces but retain its flexibility at the edges and still be considered "rigid." Such a band is also considered "collapsible" since its flexible edges act as pin-less hinges connecting the substantially inflexible faces, and the band can be essentially flattened by folding at least two of its edges. With respect to the faces as well as the pins, flexibility is determined as follows. A length of the material is clamped horizontally along one side on a flat support surface with an unsupported overhang portion of length "L". The vertical distance "D" that the unclamped side of the overhang portion drops below the flat support surface is measured. The ratio D/L gives a measure of drapability. When the ratio approaches 1, the structure/face is highly flexible, and when the ratio approaches 0, it is very rigid or inflexible. Structures are considered rigid when D/L is less than about 0.2, more preferably less than about 0.1.

The structural designs of the present invention, especially the three band cube design, enhance the blast containment capability of the container. Blast containment capability is also enhanced with increased areal density of the container. The "areal density" is the weight of a structure per unit area of the structure in $kg/m^2$, as discussed in more detail in conjunction with the examples which follow below.

The preferred blast resistant materials utilized in forming the containers and bands of the present invention are oriented films, fibrous layers, and/or a combination thereof. A resin matrix may optionally be used with the fibrous layers, and a film (oriented or not) may comprise the resin matrix.

Uniaxially or biaxially oriented films acceptable for use as the blast resistant material can be single layer, bilayer, or multilayer films selected from the group consisting of homopolymers and copolymers of thermoplastic polyolefins, thermoplastic elastomers, crosslinked thermoplastics, crosslinked elastomers, polyesters, polyamides, fluorocarbons, urethanes, epoxies, polyvinylidene chloride, polyvinyl chloride, and blends thereof. Films of choice are high density polyethylene, polypropylene, and polyethylene/elastomeric blends. Film thickness preferably ranges from about 0.2 to 40 mils, more preferably from about 0.5 to 20 mils, most preferably from about 1 to 15 mils.

For purposes of this invention, a fibrous layer comprises at least one network of fibers either alone or with a matrix. Fiber denotes an elongated body, the length dimension of which is much greater than the transverse dimensions of width and thickness. Accordingly, the term fiber includes monofilament, multifilament, braid, rope, ribbon, strip, staple and other forms of chopped, cut or discontinuous fiber and the like having regular or irregular cross-sections. The term fiber includes a plurality of any one or combination of the above.

The cross-sections of filaments for use in this invention may vary widely. They may be circular, flat or oblong in cross-section. They also may be of irregular or regular multilobal cross-section having one or more regular or irregular lobes projecting from the linear or longitudinal axis of the fibers. It is particularly preferred that the filaments be of substantially circular, flat or oblong cross-section, most preferably the former.

By network is meant a plurality of fibers arranged into a predetermined configuration or a plurality of fibers grouped together to form a twisted or untwisted yarn, which yarns are arranged into a predetermined configuration. For example, the fibers or yarn may be formed as a felt or other nonwoven, knitted or woven (plain, basket, satin and crow feet weaves, etc.) into a network, or formed into a network by any conventional techniques. According to a particularly preferred network configuration, the fibers are unidirectionally aligned so that they are substantially parallel to each other along a common fiber direction. Continuous length fibers are most preferred although fibers that are oriented and have a length of from about 3 to 12 inches (about 7.6 to about 30.4 centimeters) are also acceptable and are deemed "substantially continuous" for purposes of this invention.

It is preferred that within a fibrous layer at least about 50 weight percent of the fibers, more preferably at least about 80 weight percent, be substantially continuous lengths of fiber that encircle the volume enclosed by the container. By encircle the volume is meant in the band or hoop direction, i.e., substantially parallel to or in the direction of the band, as band has been previously defined and shown. By substantially parallel to or in the direction of the band is meant within ±10°. The preferred fibrous material comprises substantially continuous, parallel lengths of fiber perpendicular to the edge.

The continuous bands can be fabricated using a number of procedures. In one preferred embodiment, the bands, especially those without resin matrix, are formed by winding fabric around a mandrel and securing the shape by suitable securing means, e.g., heat and/or pressure bonding, heat shrinking, adhesives, staples, sewing and other securing means known to those of skill in the art. Sewing can be either spot sewing, line sewing or sewing with intersecting sets of parallel lines. Stitches are typically utilized in sewing, but no specific stitching type or method constitutes a preferred securing means for use in this invention. Fiber used to form stitches can also vary widely. Useful fiber may have a relatively low modulus or a relatively high modulus, and may have a relatively low tenacity or a relatively high tenacity. Fiber for use in the stitches preferably has a tenacity equal to or greater than about 2 g/d and a modulus equal to or greater than about 20 g/d. All tensile properties are evaluated by pulling a 10 in (25.4 cm.) fiber length clamped between barrel clamps at 10 in/min (25.4 cm/min) on an Instron Tensile Tester. In cases where it is desirable to make the band somewhat more rigid, pockets can be sewn in the fabric into which rigid plates may be inserted, or the plates themselves can be sewn into the band between wraps of material. This is another "collapsible" embodiment of rigid bands, i.e., the faces are rigid due to the presence of the rigid plates, but the edges are flexible due to the flexible fabric forming the bands or can be bent by, e.g., the weight of the rigid face portion. An advantage to the collapsible embodiments of the present invention is that the apparatus can be transported flat and set up immediately prior to use. Another way to make wraps of fabric selectively rigid within a band is by way of stitch patterns, e.g., parallel rows of stitches can be used across the face portions of the band to make them rigid while leaving the joints/edges unsewn to create another "collapsible" rigid band.

The type of fibers used in the blast resistant material may vary widely and can be inorganic or organic fibers. Preferred fibers for use in the practice of this invention, especially for the substantially continuous lengths, are those having a tenacity equal to or greater than about 10 grams/denier (g/d) and a tensile modulus equal to or greater than about 200 g/d (as measured by an Instron Tensile Testing machine). Particularly preferred fibers are those having a tenacity equal to or greater than about 20 g/d and a tensile modulus equal to or greater than about 500 g/d. Most preferred are those embodiments in which the tenacity of the fibers is equal to or greater than about 25 g/d and the tensile modulus is equal to or greater than about 1000 g/d. In the practice of this invention, the fibers of choice have a tenacity equal to or greater than about 30 g/d and a tensile modulus equal to or greater than about 1200 g/d.

High performance fibers can be incorporated into bands together and/or in conjunction with other fibers which may be inorganic, organic or metallic. Preferably the high performance fiber is the continuous (warp) fiber and the other fiber is the fill fiber. Optionally the other fiber can be incorporated in both warp and fill. Such fabrics are designated hybrid fabrics. Hybrid fabrics can be used to construct one or more bands of the container. Preferably, hybrid fabrics would be used to construct part or all of the outer band. Bands can also be created by simultaneously or serially wrapping one or more fabrics made with conventional fibers with one or more fabrics made from high performance fibers.

The denier of the fiber may vary widely. In general, fiber denier is equal to or less than about 8,000. In the preferred embodiments of the invention, fiber denier is from about 10 to about 4000, and in the more preferred embodiments of the invention, fiber denier is from about 10 to about 2000. In the most preferred embodiments of the invention, fiber denier is from about 10 to about 1500. Fabrics made with coarser (higher) denier fibers will allow more venting of gases, which may be desirable in some cases.

Useful inorganic fibers include S-glass fibers, E-glass fibers, carbon fibers, boron fibers, alumina fibers, zirconia-silica fibers, alumina-silica fibers and the like.

Illustrative of useful inorganic filaments for use in the present invention are glass fibers such as fibers formed from quartz, magnesia alumuninosilicate, non-alkaline aluminoborosilicate, soda borosilicate, soda silicate, soda lime-aluminosilicate, lead silicate, non-alkaline lead boroalumina, non-alkaline barium boroalumina, non-alkaline zinc boroalumina, non-alkaline iron aluminosilicate, cadmium borate, alumina fibers which include "saffil" fiber in eta, delta, and theta phase form, asbestos, boron, silicone carbide, graphite and carbon such as those derived from the carbonization of saran, polyaramide (Nomex), nylon, polybenzimidazole, polyoxadiazole, polyphenylene, PPR, petroleum and coal pitches (isotropic), mesophase pitch, cellulose and polyacrylonitrile, ceramic fibers, metal fibers as for example steel, aluminum metal alloys, and the like.

Illustrative of useful organic filaments are those composed of polyesters, polyolefins, polyetheramides, fluoropolymers, polyethers, celluloses, phenolics, polyesteramides, polyurethanes, epoxies, aminoplastics, silicones, polysulfones, polyetherketones, polyetheretherketones, polyesterimides, polyphenylene sulfides, polyether acryl ketones, poly(amide-imides), and polyimides. Illustrative of other useful organic filaments are those composed of aramids (aromatic polyamides), such as poly(m-xylylene adipamide), poly(p-xylylene sebacamide), poly(2,2,2-trimethyl-hexamethylene terephthalamide), poly(piperazine sebacamide), poly (metaphenylene isophthalamide) and poly(p-phenylene terephthalamide); aliphatic and cycloaliphatic polyamides, such as the copolyamide of 30% hexamethylene diammonium isophthalate and 70% hexamethylene diammonium adipate, the copolyamide of up to 30% bis-(-amidocyclohexyl) methylene, terephthalic acid and caprolactam, polyhexamethylene adipamide (nylon 66), poly(butyrolactam) (nylon 4), poly(9-aminonoanoic acid) (nylon 9), poly (enantholactam) (nylon 7), poly(capryllactam) (nylon 8), polycaprolactam (nylon 6), poly(p-phenylene terephthalamide), polyhexamethylene sebacamide (nylon 6,10), polyaminoundecanamide (nylon 11), polydodecanolactam (nylon 12), polyhexamethylene isophthalamide, polyhexamethylene terephthalamide, polycaproamide, poly(nonamethylene azelamide (nylon 9,9), poly(decamethylene azelamide) (nylon 10,9), poly(decamethylene sebacamide) (nylon 10,10), poly[bis-(4-aminocyclohexyl)methane 1,10-decanedicarboxamide] (Qiana) (trans), or combinations thereof; and aliphatic, cycloaliphatic and aromatic polyesters such as poly(1,4-cyclohexylidene dimethyl eneterephthalate) cis and trans, poly(ethylene-1,5-naphthalate), poly(ethylene-2,6-naphthalate), poly(1,4-cyclohexane dimethylene terephthalate) (trans), poly(decamethylene terephthalate), poly(ethylene terephthalate), poly(ethylene isophthalate), poly (ethylene oxybenzoate), poly(para-hydroxy benzoate), poly (dimethylpropiolactone), poly(decamethylene adipate), poly (ethylene succinate), poly(ethylene azelate), poly (decamethylene sabacate), poly($\alpha$,$\alpha$-dimethylpropiolactone), and the like.

Also illustrative of useful organic filaments are those of polybenzoxazoles and polybenzothiazoles, as detailed in *the Handbook of Fiber Science and Technology: Volume II, High Technology Fibers, Part D*, edited by Menachem Lewin.

Also illustrative of useful organic filaments are those of liquid crystalline polymers such as lyotropic liquid crystalline polymers which include polypeptides such as poly-$\alpha$-benzyl L-glutamate and the like; aromatic polyamides such as poly(1,4-benzamide), poly(chloro-1-4-phenylene terephthalamide), poly(1,4-phenylene fumaramide), poly(chloro-1,4-phenylene fumaramide), poly(4,4'-benzanilide trans, trans-muconamide), poly(1,4-phenylene mesaconamide), poly(1,4-phenylene) (trans-1,4-cyclohexylene amide), poly(chloro-1,4-phenylene) (trans-1,4-cyclohexylene amide), poly(1,4-phenylene 1,4-dimethyl-trans-1,4-cyclohexylene amide), poly(1,4-phenylene 2,5-pyridine amide), poly(chloro-1,4-phenylene 2,5-pyridine amide), poly(3,3'-dimethyl-4,4'-biphenylene 2,5 pyridine amide), poly(1,4-phenylene 4,4'-stilbene amide), poly(chloro-1,4-phenylene 4,4'-stilbene amide), poly(1,4-phenylene 4,4'-azobenzene amide), poly(4,4'-azobenzene 4,4'-azobenzene amide), poly(1,4-phenylene 4,4'-azoxybenzene amide), poly(4,4'-azobenzene 4,4'-azoxybenzene amide), poly(1,4-cyclohexylene 4,4'-azobenzene amide), poly(4,4'-azobenzene terephthal amide), poly(3,8-phenanthridinone terephthal amide), poly(4,4'-biphenylene terephthal amide), poly(4,4'-biphenylene 4,4'-bibenzo amide), poly(1,4-phenylene 4,4'-bibenzo amide), poly(1,4-phenylene 4,4'-terephenylene amide), poly(1,4-phenylene 2,6-naphthal amide), poly(1,5-naphthalene terephthal amide), poly(3,3'-dimethyl-4,4-biphenylene terephthal amide), poly(3,3'-dimethoxy-4,4'-biphenylene terephthal amide), poly(3,3'-dimethoxy-4,4-biphenylene 4,4'-bibenzo amide) and the like; polyoxamides such as those derived from 2,2'-dimethyl-4,4'-diamino biphenyl and chloro-1,4-phenylene diamine; polyhydrazides such as poly chloroterephthalic hydrazide, 2,5-pyridine dicarboxylic acid hydrazide) poly(terephthalic hydrazide), poly(terephthalic-chloroterephthalic hydrazide) and the like; poly(amide-hydrazides) such as poly(terephthaloyl 1,4 amino-benzhydrazide) and those prepared from 4-amino-benzhydrazide, oxalic dihydrazide, terephthalic dihydrazide and para-aromatic diacid chlorides; polyesters such as those of the compositions include poly(oxy-trans-1,4-cyclohexyleneoxycarbonyl-trans-1,4-cyclohexylenecarbonyl-β-oxy-1,4-phenyl-eneoxyteraphthaloyl) and poly(oxy-cis-1,4-cyclohexyleneoxycarbonyl-trans-1,4-cyclohexylenecarbonyl-β-oxy-1,4-phenyleneoxyterephthaloyl) in methylene chloride-o-cresol poly(oxy-trans-1,4-cyclohexylene oxycarbonyl-trans-1,4-cyclohexylenecarbonyl-b-oxy-(2-methyl-1,4-phenylene) oxy-terephthaloyl) in 1,1,2,2-tetrachloroethane-o-chlorophenol-phenol (60:25:15 vol/vol/vol), poly[oxy-trans-1,4-cyclohexyleneoxycarbonyl-trans-1,4-cyclohexylenecarbonyl-b-oxy(2-methyl-1,3-phenylene) oxy-terephthaloyl] in o-chlorophenol and the like; polyazomethines such as those prepared from 4,4'-diaminobenzanilide and terephthalaldehyde, methyl-1,4-phenylenediamine and terephthalaldehyde and the like; polyisocyanides such as poly(-phenyl ethyl isocyanide), poly(n-octyl isocyanide) and the like; polyisocyanates such as poly(n-alkyl isocyanates) as for example poly(n-butyl isocyanate), poly(n-hexyl isocyanate) and the like; lyotropic crystalline polymers with heterocyclic units such as poly(1,4-phenylene-2,6-benzobisthiazole) (PBT), poly(1,4-phenylene-2,6-benzobisoxazole) (PEO), poly(1,4-phenylene-1,3,4-oxadiazole), poly(1,4-phenylene-2,6-benzobisimidazole), poly[2,5(6)-benzimidazole] (AB-PBI), poly[2,6-(1,4-phenylene-4-phenylquinoline], poly[1,1'-(4,4'-biphenylene)-6,6'-bis(4-phenylquinoline)] and the like; polyorganophosphazines such as polyphosphazine, polybisphenoxyphosphazine, poly [bis(2,2,2' trifluoroethylene)phosphazine] and the like; metal polymers such as those derived by condensation of trans-bis (tri-n-butylphosphine)platinum dichloride with a bisacetylene or trans-bis(tri-n-butylphosphine)bis(1,4-butadienyl) platinum and similar combinations in the presence of cuprous iodine and an amide; cellulose and cellulose derivatives such as esters of cellulose as for example triacetate cellulose, acetate cellulose, acetate-butyrate cellulose, nitrate cellulose, and sulfate cellulose, ethers of cellulose as for example, ethyl ether cellulose, hydroxymethyl ether cellulose, hydroxypropyl ether cellulose, carboxymethyl ether cellulose, ethyl hydroxyethyl ether cellulose, cyanoethylethyl ether cellulose, ether-esters of cellulose as for example acetoxyethyl ether cellulose and benzoyloxypropyl ether cellulose, and urethane cellulose as for example phenyl urethane cellulose; thermotropic liquid crystalline polymers such as celluloses and their derivatives as for example hydroxypropyl cellulose, ethyl cellulose propionoxypropyl cellulose; thermotropic copolyesters as for example copolymers of 6-hydroxy-2-naphthoic acid and p-hydroxy benzoic acid, copolymers of 6-hydroxy-2-naphthoic acid, terephthalic acid and p-amino phenol, copolymers of 6-hydroxy-2-naphthoic acid, terephthalic acid and hydroquinone, copolymers of 6-hydroxy-2-naphthoic acid, p-hydroxy benzoic acid, hydroquinone and terephthalic acid, copolymers of 2,6-naphthalene dicarboxylic acid, terephthalic acid, isophthalic acid and hydroquinone, copolymers of 2,6-naphthalene dicarboxylic acid and terephthalic acid, copolymers of p-hydroxybenzoic acid, terephthalic acid and 4,4'-dihydroxydiphenyl, copolymers of p-hydroxybenzoic acid, terephthalic acid, isophthalic acid and 4,4'-dihydroxydiphenyl, p-hydroxybenzoic acid, isophthalic acid, hydroquinone and 4,4'-dihydroxybenzophenone, copolymers of phenylterephthalic acid and hydroquinone, copolymers of chlorohydroquinone, terephthalic acid and p-acetoxy cinnamic acid, copolymers of chlorohydroquinone, terephthalic acid and ethylene dioxy-r,r'-dibenzoic acid, copolymers of hydroquinone, methylhydroquinone, p-hydroxybenzoic acid and isophthalic acid, copolymers of (1-phenylethyl)hydroquinone, terephthalic acid and hydroquinone, and copolymers of poly(ethylene terephthalate) and p-hydroxybenzoic acid; and thermotropic polyamides and thermotropic copoly(amide-esters).

Also illustrative of useful organic filaments are those composed of extended chain polymers formed by polymerization of α,β-unsaturated monomers of the formula:

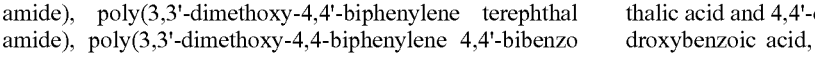

$$R_1R_2—C=CH_2$$

wherein:

$R_1$ and $R_2$ are the same or different and are hydrogen, hydroxy, halogen, alkylcarbonyl, carboxy, alkoxycarbonyl, heterocycle or alkyl or aryl either unsubstituted or substituted with one or more substituents selected from the group consisting of alkoxy, cyano, hydroxy, alkyl and aryl. Illustrative of such polymers of α,β-unsaturated monomers are polymers including polystyrene, polyethylene, polypropylene, poly(1-octadecene), polyisobutylene, poly(1-pentene), poly(2-methylstyrene), poly(4-methylstyrene), poly(1-hexene), poly(4-methoxystyrene), poly(5-methyl-1-hexene), poly(4-methylpentene), poly(1-butene), polyvinyl chloride, polybutylene, polyacrylonitrile, poly(methyl pentene-1), poly(vinyl alcohol), poly(vinyl acetate), poly(vinyl butyral), poly(vinyl chloride), poly(vinylidene chloride), vinyl chloride-vinyl acetate chloride copolymer, poly(vinylidene fluoride), poly(methyl acrylate), poly(methyl methacrylate), poly (methacrylonitrile), poly(acrylamide), poly(vinyl fluoride), poly(vinyl formal), poly(3-methyl-1-butene), poly(4-methyl-1-butene), poly(4-methyl-1-pentene), poly(1-hexane), poly(5-methyl-1-hexene), poly(1-octadecene), poly(vinyl cyclopentane), poly(vinylcyclohexane), poly(a-vinylnaphthalene), poly(vinyl methyl ether), poly(vinylethylether), poly(vinyl propylether), poly(vinyl carbazole), poly(vinyl pyrrolidone), poly(2-chlorostyrene), poly(4-chlorostyrene), poly(vinyl formate), poly(vinyl butyl ether), poly(vinyl octyl ether), poly(vinyl methyl ketone), poly(methylisopropenyl ketone), poly(4-phenylstyrene) and the like.

The most useful high strength fibers include extended chain polyolefin fibers, particularly extended chain polyethylene (ECPE) fibers, aramid fibers, polybenzoxazole fibers, polybenzothiazole fibers, polyvinyl alcohol fibers, polyacrylonitrile fibers, liquid crystal copolyester fibers, polyamide fibers, glass fibers, carbon fibers and/or mixtures thereof. Particularly preferred are the polyolefin and aramid fibers. If a mixture of fibers is used, it is preferred that the fibers be a mixture of at least two of polyethylene fibers, aramid fibers, polyamide fibers, carbon fibers, and glass fibers.

U.S. Pat. No. 4,457,985 generally discusses such extended chain polyethylene and polypropylene fibers, and the disclosure of this patent is hereby incorporated by reference to the extent that it is not inconsistent herewith. In the case of polyethylene, suitable fibers are those of weight average molecular weight of at least 150,000, preferably at least one million and more preferably between two million and five million. Such extended chain polyethylene fibers may be grown in solution as described in U.S. Pat. No. 4,137,394 or U.S. Pat. No. 4,356,138, or may be spun from a solution to form a gel structure, as described in German Off. 3,004,699 and GB 2051667, and especially as described in U.S. Pat. Nos. 4,413,110, 4,551,296, all of which are hereby incorporated by reference. As used herein, the term polyethylene shall mean a predominantly linear polyethylene material that may contain minor amounts of chain branching or comonomers not exceeding 5 modifying units per 100 main chain carbon atoms, and that may also contain admixed therewith not more than about 50 weight percent of one or more polymeric additives such as alkene-1-polymers, in particular low density polyethylene, polypropylene or polybutylene, copolymers containing mono-olefins as primary monomers, oxidized polyolefins, graft polyolefin copolymers and polyoxymethylenes, or low molecular weight additives such as antioxidants, lubricants, ultraviolet screening agents, colorants and the like which are commonly incorporated by reference. Depending upon the formation technique, the draw ratio and temperatures, and other conditions, a variety of properties can be imparted to these filaments. The tenacity of the filaments is at least about 15 g/d, preferably at least 20 g/d, more preferably at least 25 g/d and most preferably at least 30 g/d. Similarly, the tensile modulus of the filaments, as measured by an Instron tensile testing machine, is at least about 200 g/d, preferably at least 500 g/d, more preferably at least 1,000 g/d, and most preferably at least 1,200 g/d. These highest values for tensile modulus and tenacity are generally obtainable only by employing solution grown or gel filament processes. Many of the filaments have melting points higher than the melting point of the polymer from which they were formed. Thus, for example, high molecular weight polyethylene of 150,000, one million and two million generally have melting points in the bulk of 138° C. The highly oriented polyethylene filaments made of these materials have melting points of from about 7° to about 13° C. higher. Thus, a slight increase in melting point reflects the crystalline perfection and higher crystalline orientation of the filaments as compared to the bulk polymer.

Similarly, highly oriented extended chain polypropylene fibers of weight average molecular weight at least 200,000, preferably at least one million and more preferably at least two million, may be used. Such extended chain polypropylene may be formed into reasonably well oriented filaments by techniques described in the various references referred to above, and especially by the technique of U.S. Pat. Nos. 4,413,110, 4,551,296, 4,663,101, and 4,784,820, hereby incorporated by reference. Since polypropylene is a much less crystalline material than polyethylene and contains pendant methyl groups, tenacity values achievable with polypropylene are generally substantially lower than the corresponding values for polyethylene. Accordingly, a suitable tenacity is at least about 8 g/d, with a preferred tenacity being at least about 11 g/d. The tensile modulus for polypropylene is at least about 160 g/d, preferably at least about 200 g/d. The melting point of the polypropylene is generally raised several degrees by the orientation process, such that the polypropylene filament preferably has a main melting point of at least 168° C., more preferably at least 170° C. The particularly preferred ranges for the above-described parameters can be advantageously provide improved performance in the final article. Employing fibers having a weight average molecular weight of at least about 200,000 coupled with the preferred ranges for the above-described parameters (modulus and tenacity) can provide advantageously improved performance in the final article.

High molecular weight polyvinyl alcohol fibers having high tensile modulus are described in U.S. Pat. No. 4,440,711, which is hereby incorporated by reference to the extent it is not inconsistent herewith. High molecular weight PV-OH fibers should have a weight average molecular weight of at least about 200,000. Particularly useful PV-OH fibers should have a modulus of at least about 300 g/d, a tenacity of at least about 7 g/d (preferably at least about 10 g/d, more preferably about 14 g/d, and most preferably at least about 17 g/d), and an energy-to-break of at least about 8 joules/g. PV-OH fibers having a weight average molecular weight of at least about 200,000, a tenacity of at least about 10 g/d, a modulus of at least about 300 g/d, and an energy to break of about 8 joules/g are likely to be more useful in producing articles of the present invention. PV-OH fibers having such properties can be produced, for example, by the process disclosed in U.S. Pat. No. 4,599,267, hereby incorporated by reference.

In the case of polyacrylonitrile (PAN), PAN fibers for use in the present invention are of molecular weight of at least about 400,000. Particularly useful PAN fiber should have a tenacity of at least about 10 g/d and an energy-to-break of at least about 8 joules/g. PAN fibers having a molecular weight of at least about 400,000, a tenacity of at least about 15 to about 20 g/d and an energy-to-break of at least about 8 joules/g are most useful; such fibers are disclosed, for example, in U.S. Pat. No. 4,535,027, hereby incorporated by reference.

In the case of aramid fibers, suitable aramid fibers formed principally from aromatic polyamide are described in U.S. Pat. No. 3,671,542, hereby incorporated by reference. Preferred aramid fiber will have a tenacity of at least about 20 g/d, a tensile modulus of at least about 400 g/d and an energy-to-break at least about 8 joules/g, and particularly preferred aramid fiber will have a tenacity of at least about 20 g/d, a modulus of at least about 480 g/d and an energy-to-break of at least about 20 joules/g. Most preferred aramid fibers will have a tenacity of at least about 20 g/d, a modulus of at least about 900 g/d and an energy-to-break of at least about 30 joules/g. For example, poly(phenylenediamine terephthalamide) filaments produced commercially by Dupont Corporation under the trade name of KEVLAR® 29, 49, 129 and 149 and having moderately high moduli and tenacity values are particularly useful in forming articles of the present invention. KEVLAR 29 has 500 g/d and 22 g/d and KEVLAR 49 has 1000 g/d and 22 g/d as values of modulus and tenacity, respectively. Also useful in the practice of this invention is poly(metaphenylene isophthalamide) fibers produced commercially by Dupont under the trade name NOMEX®.

In the case of liquid crystal copolyesters, suitable fibers are disclosed, for example, in U.S. Pat. Nos. 3,975,487; 4,118,372; and 4,161,470, hereby incorporated by reference. Tenacity's of about 15 to about 30 g/d and preferably about 20 to about 25 g/d, and tensile modulus of about 500 to 1500 g/d and preferably about 1000 to about 1200 g/d are particularly desirable.

If a matrix material is employed in the practice of this invention, it may comprise one or more thermosetting resins, or one or more thermoplastic resins, or a blend of such resins. The choice of a matrix material will depend on how the bands are to be formed and used. The desired rigidity of the band and/or ultimate container will greatly influence choice of matrix material. As used herein "thermoplastic resins" are resins which can be heated and softened, cooled and hardened a number of times without undergoing a basic alteration, and "thermosetting resins" are resins which cannot be resoftened and reworked after molding, extruding or casting and which attain new, irreversible properties when once set at a temperature which is critical to each resin.

The tensile modulus of the matrix material in the band(s) may be low (flexible) or high (rigid), depending upon how the band is to be used. The key requirement of the matrix material is that it be flexible enough to process at whatever stage of the band-forming method it is added. In this regard, thermosetting resins which are fully uncured or have been B-staged but not fully cured would probably process acceptably, as would fully cured thermosetting resins which can be plied together with compatible adhesives. Heat added to the process would permit processing of higher modulus thermoplastic materials which are too rigid to process otherwise; the temperature "seen" by the material and duration of exposure must be such that the material softens for processing without adversely affecting the impregnated fibers, if any.

With the foregoing in mind, thermosetting resins useful in the practice of this invention may include, by way of illustration, bismaleimides, alkyds, acrylics, amino resins, urethanes, unsaturated polyesters, silicones, epoxies, vinylesters and mixtures thereof. Greater detail on useful thermosetting resins may be found in U.S. Pat. No. 5,330,820, hereby incorporated by reference. Particularly preferred thermosetting resins are the epoxies, polyesters and vinylesters, with an epoxy being the thermosetting resin of choice.

Thermoplastic resins for use in the practice of this invention may also vary widely. Illustrative of useful thermoplastic resins are polylactones, polyurethanes, polycarbonates, polysulfones, polyether ether ketones, polyamides, polyesters, poly(arylene oxides), poly(arylene sulfides), vinyl polymers, polyacrylics, polyacrylates, polyolefins, ionomers, polyepichlorohydrins, polyetherimides, liquid crystal resins, and elastomers and copolymers and mixtures thereof. Greater detail on useful thermoplastic resins may be found in U.S. Pat. No. 5,330,820, hereby incorporated by reference. Particularly preferred low modulus thermoplastic (elastomeric) resins are described in U.S. Pat. No. 4,820,568, hereby incorporated by reference, in columns 6 and 7, especially those produced commercially by the Shell Chemical Co. which are described in the bulletin "KRATON Thermoplastic Rubber", SC-68-81. Particularly preferred thermoplastic resins are the high density, low density, and linear low density polyethylenes, alone or as blends, as described in U.S. Pat. No. 4,820,458. A broad range of elastomers may be used, including natural rubber, styrene-butadiene copolymers, polyisoprene, polychloroprene-butadiene-acrylonitrile copolymers, ER rubbers, EPDM rubbers, and polybutylenes.

In the preferred embodiments of the invention, the matrix comprises a low modulus polymeric matrix selected from the group consisting of a low density polyethylene; a polyurethane; a flexible epoxy; a filled elastomer vulcanizate; a thermoplastic elastomer; and a modified nylon-6.

The proportion of matrix to filament in the bands is not critical and may vary widely. In general, the matrix material forms from about 10 to about 90% by volume of the fibers, preferably about 10 to 80%, and most preferably about 10 to 30%.

If a matrix resin is used, it may be applied in a variety of ways to the fiber, e.g., encapsulation, impregnation, lamination, extrusion coating, solution coating, solvent coating. Effective techniques for forming coated fibrous layers suitable for use in the present invention are detailed in referenced U.S. Pat. Nos. 4,820,568 and 4,916,000.

The blast resistant bands can be made according to the following method steps:

A. wrapping at least one flexible sheet comprising a high strength fiber material around a mandrel in a plurality of layers under tension sufficient to remove voids between successive layers;

B. securing the layers of material together to form a substantially seamless and at least partially rigid first band; and C. removing the band from the mandrel.

The wrapping tension typically is in the range of from about 0.1 to 50 pounds per linear inch, more preferably in the range of from about 2 to 50 pounds per linear inch, most preferably in the range of from about 2 to 20 pounds per linear inch. The fabric layers can be secured in a variety of ways, e.g., by heat and/or pressure bonding, heat shrinking, adhesives, staples, and sewing, as discussed above. It is most preferred that the securing step comprises the steps of contacting the fiber material with a resin matrix and consolidating the layers of high strength fiber material and the resin matrix either on or off of the mandrel. The fiber material can be contacted with a resin matrix either before, during or after the wrapping step. Some of the ways in which this can be done are detailed further below. By "consolidating" is meant combining the matrix material and the fiber network into a single unitary layer. Depending upon the type of matrix material and how it is applied to the fibers, consolidation can occur via drying, cooling, pressure or a combination thereof, optionally in combination with application of an adhesive. "Consolidating" is also meant to encompass spot consolidation wherein the faces of a band are consolidated but the edges are not. In this fashion, the faces can be made rigid while the edges retain the ability to bend or be bent to permit collapsing or folding of the band. "Sheet" is meant to include a single fiber or roving for purposes of this invention.

In one preferred embodiment, the flexible sheet material is formed as follows. Yarn bundles of from about 30 to about 2000 individual filaments of less than about 12 denier, and more preferably of about 100 individual filaments of less than about 7 denier, are supplied from a creel, and are led through guides and a spreader bar into a collimating comb just prior to coating. The collimating comb aligns the filaments coplanarly and in a substantially parallel, and unidirectional fashion. The filaments are then sandwiched between release papers, one of which is coated with a wet matrix resin. This system is then passed under a series of pressure rolls to complete the impregnation of the filaments. The top release paper is pulled off and rolled up on a take-up reel while the impregnated network of filaments proceeds through a heated tunnel oven to remove solvent and then be taken up. Alternatively, a single release paper coated with the wet matrix resin can be used to create the impregnated network of filaments. One such impregnated network is referred to as unidirectional prepreg, tape or sheet material and is one of the preferred feed materials for making some of the bands in the examples below, hereafter, "unitape."

In an alternate embodiment of this invention, two such impregnated networks are continuously cross plied, preferably by cutting one of the networks into lengths that can be placed successively across the width of the other network in a 0°/90° orientation. This forms a continuous flexible sheet of high strength fiber material, hereafter referred to as "shield." See U.S. Pat. No. 5,173,138, hereby incorporated by reference. This flexible sheet (fibrous layer), optionally with film as discussed below, can then be used to form one or more bands in accordance with the methods of the present invention. This fibrous layer is sufficiently flexible to wrap in accordance with the methods of the present invention; it can then be made substantially rigid (per the drapability test), if desired, either by the sheer number of wraps or by the manner in which it is secured. The weight percent of fiber in the hoop direction of the band can be varied by varying the number and the orientation of the networks. One way to achieve varying weight percents of fiber in the hoop direction is to make a composite sheet from the cross plied material and one or more layers of unidirectional tape/material (see the examples which follow). By way of example, two unidirectional sheets with one cross-plied sheet forms an imbalanced fabric having about 75 weight percent fiber in the hoop direction.

In another embodiment, one or more uncured thermosetting resin-impregnated networks of high strength filaments are similarly formed into a flexible sheet for winding around a mandrel into a band or bands in accordance with the present invention followed by curing (or spot curing) of the resin.

Film may optionally be used as one or more layers of the band(s), preferably as an outer layer. The film, or films, can be added as the matrix material (lamination), with the matrix material or after the matrix material, as the case may be. When the film is added as the matrix material, it is preferably simultaneously wound with the fiber or fabric (network) onto a mandrel and subsequently consolidated; the mandrel may optionally become part of the structure. The film thickness minimally is about 0.1 mil and may be as large as desired so long as the length is still sufficiently flexible to permit band formation. The preferred film thickness ranges from 0.1 to 50 mil, with 0.35 to 10 mil being most preferred. Films can also be used on the surfaces of the bands for a variety of reasons, e.g., to vary frictional properties, to increase flame retardance, to increase chemical resistance, to increase resistance to radiation degradation, and/or to prevent diffusion of material into the matrix. The film may or may not adhere to the band depending on the choice of film, resin and filament. Heat and/or pressure may cause the desired adherence, or it may be necessary to use an adhesive which is heat or pressure sensitive between the film and the band to cause the desired adherence. Examples of acceptable adhesives include polystyrene-polyisoprene-polystyrene block copolymer, thermoplastic elastomers, thermoplastic and thermosetting polyurethanes, thermoplastic and thermosetting polysulfides, and typical hot melt adhesives.

Films which may be used as matrix materials in the present invention include thermoplastic polyolefinic films, thermoplastic elastomeric films, crosslinked thermoplastic films, crosslinked elastomeric films, polyester films, polyamide films, fluorocarbon films, urethane films, polyvinylidene chloride films, polyvinyl chloride films and multilayer films. Homopolymers or copolymers of these films can be used, and the films may be unoriented, uniaxially oriented or biaxially oriented. The films may include pigments or plasticizers.

Useful thermoplastic polyolefinic films include those of low density polyethylene, high density polyethylene, linear low density polyethylene, polybutylene, and copolymers of ethylene and propylene which are crystalline. Polyester films which may be used include those of polyethylene terephthalate and polybutylene terephthalate.

Pressure can be applied by an interleaf material made from a plastic film wrap which shrinks when the band is exposed to heat; acceptable materials for this application, by way of example, are polyethylene, polyvinyl chloride and ethylene-vinylacetate copolymers.

The temperatures and/or pressures to which the bands of the present invention are exposed to cure the thermosetting resin or to cause adherence of the networks to each other and optionally, to at least one sheet of film, vary depending upon the particular system used. For example, for extended chain polyethylene filaments, temperatures range from about 20° C. to about 150° C., preferably from about 50° C. to about 145° C., more preferably from about 80° C. to about 120° C., depending on the type of matrix material selected. The pressures may range from about 10 psi (69 kPa) to about 10,000 psi (69,000 kPa). A pressure between about 10 psi (69 kPa) and about 500 psi (3450 kPa), when combined with temperatures below about 100° C. for a period of time less than about 1.0 min., may be used simply to cause adjacent filaments to stick together. Pressures from about 100 psi (690 kPa) to about 10,000 psi (69,000 kPa), when coupled with temperatures in the range of about 100° C. to about 155° C. for a time of between about 1 to about 5 min., may cause the filaments to deform and to compress together (generally in a film-like shape). Pressures from about 100 psi (690 kPa) to about 10,000 psi (69,000 kPa), when coupled with temperatures in the range of about 150° C. to about 155° C. for a time of between 1 to 5 min., may cause the film to become translucent or transparent. For polypropylene filaments, the upper limitation of the temperature range would be about 10 to about 20° C. higher than for ECPE filament. For aramid filaments, especially Kevlar filaments, the temperature range would be about 149 to 205° C. (about 300 to 400° F.).

Pressure may be applied to the bands on the mandrel in a variety of ways. Shrink wrapping with plastic film wrap is mentioned above. Autoclaving is another way of applying pressure, in this case simultaneous with the application of heat. The exterior of each band may be wrapped with a shrink wrappable material and then exposed to temperatures which will shrink wrap the material and thus apply pressure to the band. The band can be shrink wrapped on the mandrel in its hoop direction which will consolidate the entire band, or the band can be shrink wrapped across its faces with material placed around the band wrapped mandrel perpendicular to the hoop direction of the band; in the latter case, the edges of the band can remain unconsolidated while the faces are consolidated.

Many of the bands formed with fibrous layers utilizing elastomeric resin systems, thermosetting resin systems, or resin systems wherein a thermoplastic resin is combined with an elastomeric or thermosetting resin can be treated with pressure alone to consolidate the band. This is the preferred way of consolidating the band. However, many of the bands formed with continuous lengths/plies utilizing thermoplastic resin systems can be treated with heat, alone or combined with pressure, to consolidate the band.

In the most preferred embodiments, each fibrous layer has an areal density of from about 0.05 to about 0.15 kg/m$^2$. The areal density per band ranges from about 0.5 to about 40 kg/m$^2$, preferably from about 1 to 20 kg/m$^2$, and more preferably from about 2 to about 10 kg/m$^2$. In the embodiment where SPECTRA SHIELD® composite nonwoven fabric forms a fibrous layer, these areal densities correspond to a number of fibrous layers per band ranging from about 10 to about 400, preferably from about 20 to about 200, more preferably from about 40 to about 100. In the three band cube design of the most preferred embodiment of the present invention, each face of the cube comprises two bands of blast resistant material, which effectively doubles the aforesaid ranges for each face of the cube. Where fibers other than high strength extended chain polyethylene, like SPECTRA® polyethylene fibers, are utilized the number of layers may need to be increased to achieve the high strength and modulus characteristics provided by the preferred embodiments.

The "pin" which passes through the loops may be soft: rope, roving, unitape, shield (preferable more that 80% of fiber in length direction of the pin), braid, belts, fabric (preferably unbalanced with more than 50 wt. of yarns in length direction of pin), and combinations thereof. Unitape, shield and fabrics may be rolled up to form a cylinder. They may be stitched, taped or subjected to heat and pressure to achieve some consolidation. Matrix may or may not be present. The preferred fibers for use in soft/flexible pins are selected from the group consisting of extended chain polyolefin fibers, aramid fibers, polybenzoxazole fibers, polybenzothiazole fibers, polyvinyl alcohol fibers, polyacrylonitrile fibers, liquid copolyester fibers, polyamide fibers, glass fibers, carbon fibers, and mixtures thereof.

Criteria for a soft pin follows. The following is a relation between the interrupted band/belt characteristics: (tensile strength of belt fiber ($S_f$), number of belt plies ($n_p$), number of ends in a ply ($n_e$), yarn (end) denier (d), width of a hinge-strip (b)) on one side, and the soft pin (rope) parameters: (rope fiber strength ($S_r$), rope denier ($d_r$) on the other side. Rope strength $N=S_r\ d_r$)

$$(S_f \times 2 \times n_e \times d \times n_p \times b)/4 \text{ Sin } \alpha = d_r S_r.$$

The means of restriction for the rope not allowing it to move (slide) through the pin-holes (hinges) (such as end-knots, friction) affect the angle $\alpha$, at which the rope actually resists separation of the ends of the belt. The closer the knots to the end hinges and the tighter the knots, the smaller is angle $\alpha$. Higher friction between the pin and the hinge surfaces leads to the similar trend. The rigid inserts for the hinges restrict their transversal contractions, and lead also to smaller $\alpha$.

Angle $\alpha$ should not be too small, because when $\alpha \rightarrow o$, the required rope strength $N=d_r.\ S_r \rightarrow \infty$. If the angle is too big the band will not function properly, allowing too much of a slack and showing inefficient participation in blast containment.

The following is an example for calculating required strength of the rope. Consider a belt constructed of 14 plies of SPECTRA SHIELD fabric.

$S_f$=30 g/den, $n_p$=14 plies; the width of individual strip b=2 in,

Then the required strength of the rope according to (1) is $$N \text{ [lbs]} = 11{,}088/\text{Sin } \alpha, \quad (2)$$

which leads to the following table:

| α° | 5 | 10 | 15 | 30 | 45 |
|---|---|---|---|---|---|
| N[lbs] | 127,000 | 63,800 | 42,800 | 22,170 | 15,680 |

Compare these numbers to the strength of 0.75 in diameter Spectra rope ($d_r$=162,000 g;

$S_f$=30 g/den i.e. Nr=106,920 lbs).

This rope is sufficiently strong for this belt design, if $\alpha \geqq 6°$ is allowed (for $b \leqq 2$ in)

The "pin" for use in the present invention may be rigid, e.g., metals, plastics, ceramics, wood, fiber-reinforced composites, and combinations thereof. If a metal is used, it can be selected from the group consisting of steel, steel alloys, aluminum, aluminum alloys, titanium, and titanium alloys. If a rigid, fiber-reinforced composite is utilized, the reinforcing fiber preferably is selected from the group consisting of aluminum fibers, aluminum alloy fibers, titanium fibers, titanium alloy fibers, steel fibers, steel alloy fibers, ceramic fibers, extended chain polyolefin fibers, aramid fibers, polybenzoxazole fibers; polybenzothiazole fibers; polyvinyl alcohol fibers, polyacrylonitrile fibers, liquid copolyester fibers, polyamide fibers, and mixtures thereof. The reinforcing fiber should be predominantly in the length direction.

Criteria for a rigid pin are as follows. For a symmetrical hinge arrangement the maximal bending moment is equal $M_{max}=\underline{qb^2/8}$ From equation for the maximal normal stress caused by the bending $$\sigma_{max}=\underline{M_{max}}/\underline{w_x},$$

where $w_x=\underline{\pi d^3/32}$ for a rod with circular cross section of diameter d, we have condition of equal strength of the belt and the hinge pin connection $$\sigma_B=\underline{qb^2}\,\underline{32}/8\pi d^3$$

$$\text{and the following criterion: } d^3 \geqq 4qb^2/\pi\sigma_b \quad (1)$$

The second criterion for the pin follows from the condition of sufficient shear strength $$\tau_b \pi d^2/4 = Q,$$

where Q=qb/4, i.e.

$$d^2 = qb/\tau_B \pi \quad (2)$$

Example: q=22000 lb; $\sigma_B$=200 ksi; $\tau_B$=100 ksi; b=2 in $d \geqq 0.824$ in — Criterion 1

$d \geqq 0.375$ in — Criterion 2

Examination of equations (1) and (2) indicates that the required pin diameter decreases as b decreases (and the number of loops increase for a given size of opening).

By blast mitigating material is meant any material that functionally improves the resistance of the container to blast. The preferred blast mitigating material utilized in forming the container assemblies of the present invention are polymeric foams; particulates, such as vermiculite; condensable gases, preferably non-flammable; heat sink materials; foamed glass; microballoons; balloons; bladders; hollow spheres, preferably elastomeric such as basketballs and tennis balls; wicking fibers; and combinations thereof. These materials are used to surround the explosive or explosive-carrying luggage within the blast resistant container, and mitigate the shock wave transmitted by an explosion.

Chemical explosions are characterized by a rapid self-propagating decomposition which liberates considerable heat and develops a sudden pressure effect through the action of heat on the produced or adjacent gases. On a weight basis, the heat of vaporization of water is similar to the heat liberated by the explosive. Provided that rapid heat transfer can be accomplished, water has the potential of greatly decreasing the blast overpressure. One technique to achieve the desired effect is to surround the explosive with heat sink materials. Effective heat sink materials include aqueous foams; aqueous solutions having antifreeze therein such as glycerin, ethylene glycol; hydrated inorganic salts; aqueous gels, preferably reinforced; aqueous mists; wet sponges, preferably elastomeric; wet profiled fibers; wet fabrics; wet felts; and combinations thereof. Aqueous foams are most preferred, especially aqueous foams having a density in the range of from about 0.01 to about 0.10 g/cm$^3$, more preferably in the range of from about 0.03 to about 0.08 g/cm$^3$.

In general, aqueous foams, through a number of mechanisms, transform energy of the explosion to heat energy within the aqueous phase. After an explosion venting of gases occurs in most containers, and when the pressure drops below some critical value the collapsed foam expands again causing additional slow release of gases. The presence of these foams decreases the rate at which energy is transmitted from the container to the surroundings, and thereby decreases the hazard. Aqueous foams for use with this invention are preferably prepared with gases (foaming agents) which do not support combustion and that are condensable. By condensable is meant that under pressure the gas will change phase from gas to liquid, simultaneously evolving their heat of condensation which heats the aqueous solution with which the gas has intimate contact. The gas selected for a particular application will depend on ambient temperature and on the pressure that the container (within which the gas is placed) can withstand. Preferred gases include the hydrocarbons such as propane, butane (both isomers), and pentane (all isomers); carbon dioxide; inorganic gases such as ammonia, sulfur dioxide; fluorocarbons, particularly the hydrochlorofluorocarbons and the hydrofluorocarbons, such as, for example, the GENETRON® series of refrigerants commercially available from AlliedSignal Inc. as set forth in the AlliedSignal GENETRON® Products Brochure, published January, 1995, and hereby incorporated by reference; and combinations thereof. A preferred gas is isobutane, which can be condensed at modest pressures, about 30 psi at room temperature. Mixtures of condensable and non-condensable gases can be used. For example, a mixture of isobutane and tetrafluoromethane can be used for a room temperature application. The blast overpressure would cause the isobutane to condense but the tetrafluoromethane would remain gaseous. Preferred gases have low sonic velocities.

In order to rapidly dispense aqueous foams, it may be desirable to use a gas that does not condense in the pressurized canister, in combination with a condensed gas. When a foam is dispensed, the remaining contents cool. Consequently it is important to have a permanent gas present so that the dispensing rate does not slow down. Carbon dioxide, nitrogen, nitrous oxide or carbon tetrafluoride could serve as such as gas. Gases which vaporize to provide propellant action cool the canister during dispensing and the rate of discharge slows.

Considerations which are used for selection of foaming agent for an aqueous foam can also be used in selection of condensable gases to be used as the blast mitigating material in collapsible containers (in the absence of aqueous foam). Such gases can conveniently be confined in bladders within the containers.

The following examples are presented to provide a more complete understanding of the invention and are not to be construed as limitations thereon. In the examples, the following technical terms are used:

(a) "Areal Density" is the weight of a structure per unit area of the structure in kg/m$^2$. Panel areal density is determined by dividing the weight of the panel by the area of the panel. For a band having a polygonal cross-sectional area, areal density of each face is given by the weight of the face divided by the surface area of the face. In most cases, the areal density of all faces is the same, and one can refer to the areal density of the structure. However in some cases the areal density of the different faces is different. For a band having a circular cross-sectional area, areal density is determined by dividing the weight of the band by the exterior surface area of the band. For a cubic box container, the areal density is the areal density of each of the six panels forming the faces of the box and does not include the areal density of any hinges or pins.

(B) "Fiber Areal Density of a Composite" corresponds to the weight of the fiber reinforcement per unit area of the composite.

(c) "$C_{50}$", a measure of blast resistance, is measured as the level of charge (in ounces) that will rupture the container/tube 50% of the time (where $C_0$ represents no failures/ruptures and $C_{100}$ represents failure 100% of the time). If failure occurs at one level and not at the next lower level, the $C_{50}$ is calculated by averaging the two levels.

In the examples that follow, the explosive used was C4, which is 90 percent RDX (cyclo-1,3,5-trimethylene-2,4,6-trinitroamine) and 10 percent of a plasticizer (polyisobutylene), a product of Hitech Inc., and a class A explosive having a shock wave velocity of 8200 m/sec (26,900 ft/sec).

The specific techniques, conditions, materials, proportions and reported data set forth to illustrate the principles of the invention are exemplary and should not be construed as limiting the scope of the invention.

EXAMPLE 1

All of the containers in this example were cube shaped and consisted of a supporting shell around which three mutually perpendicular reinforcing fiber/fabric bands were wrapped. The cube had an inner side length of 15 inches.

The materials of construction were as follows. The supporting cubic shells were made of 0.25 inch thick plywood panels nailed onto 0.75×0.75 inch wood molding strips running along the inside edges. The shells weighed about 3.20 kg. One of the six sides of the cubic shell was left open, i.e., without any plywood. The bands were made of SPECTRA Unitape, a product of AlliedSignal, Inc. (a parallel array of SPECTRA 1000™ high performance extended chain polyethylene fibers in a matrix of 20 wt. % of Shell KRATON D1107 rubber, areal density of about 0.0675 kg/m$^2$, 9.6 end/inch, 1300 denier fiber, 240 filaments per fiber), and of SPECTRA SHIELD fabric, also a commercial product of AlliedSignal, Inc., and comprising a laminate of two plies of Unitape normal to each other and having an areal density of about 0.135 kg/m$^2$, i.e., double that of the Unitape. In addition a woven SPECTRA fabric was used alone to form some bands. The fabric was woven by Clark-Schwebel Inc., Anderson, N.C. 29622, as style 955, areal density of about 3.26 oz/yd$^2$, 55×55 yarns/inch, plain weave, using SPECTRA 1000 yarn of 215 denier. 1000/215/3 SPECTRA sewing thread, i.e., three strands of SPECTRA 1000 yarn of 215 denier twisted into a sewing thread, made by Advance Fiber Technology Corp., 15 Industrial Rd, Fairfield, N.J. 07006. A woven KEVLAR® fabric was also used alone to form some bands. This fabric was also woven by Clark-Schwebel Inc., style 745, 13.6 oz/yd$^2$, KEVLAR 129 fiber, 3000 denier, 17×17 yarns/inch, plain weave.

Three identical containers, C1-C3, were made in which each of the three bands was continuous and removable to gain access to the inside (See FIGS. 8A-8F; note that the inner plywood shell is not shown). These containers were made as controls for comparison with containers in which one of the three bands was interrupted across its length, i.e., discontinuous, and could be opened and closed by insertion of a pin in a hinge—like closure mechanism.

The six sides of each cube shaped box are referred to as follows: open side=front, the other five sides are top, bottom, left, right, and back, respectively. For the control boxes, C1-C3, the inner band 11 was made in the following manner. Two wraps of a continuous strip of SPECTRA SHIELD fabric, 15 inches wide, were made around the front, top, back, bottom, followed by 34 wraps of SPECTRA Unitape, followed by 2 more wraps of SPECTRA SHIELD fabric. This band was covered inside and out with a 2 mil thick film of linear low density polyethylene (LLDPE) to facilitate sliding of the band onto and off of the shell. The various plies were held together with double stick adhesive tape as needed. The middle band 12 consisted of two portions: a first, not removable portion and a second, removable portion. The first portion of band 12 was made of 4 wraps of SPECTRA SHIELD fabric, 15 inches wide, placed around the top, right, bottom, and left side of the shell. The second, removable portion of band 12 consisted of two plies of SPECTRA SHIELD fabric, twenty-six plies of SPECTRA Unitape and two more plies of SPECTRA SHIELD fabric. It was covered with LLDPE film like band 11, and followed the wrap direction of the first portion of band 12. The outer band 13 was made of twenty-five wraps of SPECTRA fabric, 16 inches wide, style 955, by Clark-Schwebel, spot stitched with 100/215/3 SPECTRA thread and placed around the front, left, back, and right side of the box. Weights of the three containers are set forth in Table 1.

Three additional containers, 1-3, which form part of the present invention, were made as described above except that the inner bands 11', 11", 11'", respectively (see FIGS. 11A-11C), could be opened across the front, open side of the plywood shell for access to the interior. An important feature of these bands is that no fibers in the hoop direction, i.e., encircling the plywood shell, were cut to make them discontinuous and thus no strength was lost.

In a normal band any fiber follows a circular path around the container. In the interrupted/discontinuous bands, to be described, any fiber will follow a path around the container to a given point and then change direction by 180 degrees and loop back to the original point from the other side. To make such a band SPECTRA Unitape, 15 inches wide, was wrapped around two sections of PVC pipe which were mounted parallel to each other in a rotating frame. The pipes were 15 inches long, 1 inch inside diameter, 1.3 inches outside diameter, and separated by about. 63 inches (far enough to make a band that could fit around the four 15-inch sides of the container and provide some overlap of the loops at the band's ends). Each of the PVC pipes had been glued to a laminated panel of 4 plies of KEVLAR fabric, 5.5×14.75 inches in size, using a vinylester resin (SILMAR). The KEVLAR panels were directed towards each other. In order to achieve the same areal density as in the control containers, 17 plies of SPECTRA Unitape, 15 inches wide, followed by two plies of SPECTRA SHIELD fabric, were wrapped around the PVC pipes. These 15 inch wide plies were separated on one pipe into seven, approximately 2 inch wide strips. Each strip was gathered and tied into a one-inch wide loop around the pipe. On the other pipe, six centrally located, two inch wide strips, flanked by two one inch wide strips, were gathered in similar fashion. In this process, on each of the two pipes, for each of the sections holding a fiber bundle, a corresponding section was cleared of fibers. These sections were sawed out, so that two half-hinges were created. These could be interlocked and connected by insertion of a pin in the remaining pipe sections. Note that no fibers were cut in the process of forming the hinges (except for the transverse fibers of the 2 plies of SPECTRA SHIELD fabric covering the Unitape) and thus no strength was lost. The three containers of the present invention, 1-3, were identical except for the pins for the hinges. The areal density of these three containers 1-3 is identical to that of the control containers C1-C3.

In container 1, the pin was a rigid steel rod, AERMET 100, HT 303769, NOJ-7781-01, from Carpenter Technology Corp., Carpenter Steel Division, Reading, Pa. 19612, diameter of 1.01 inches, length of 15.75 inches, and weight of 1646 gm (41.1 gm/cm).

In container 2, the pin was a flexible SPECTRA rope, Part Code 7102048SZZL, Maxibraid—Maxijacket, gray, from Yale Cordage Co., Rigging Division, 100 Fore Street, Portland, Me. 04101, 0.75 inch diameter cord, 67 inches long, 307 gm (1.80 gm/cm) weight. This piece of rope was threaded through the knuckles (loops) of the hinge, leaving equal excess on both sides. A double knot was made on one side of the hinge and left intact. A single knot was made on the other side as close as possible to the hinge after insertion of the rope. The excess rope and knots were pushed into the box interior.

In container 3, the pin was made as follows. SPECTRA Unitape was wrapped longitudinally around a 0.5 inch diameter aluminum rod: Fifteen plies of Unitape, 10 inches wide normal to the fiber direction and 46 inches long in the fiber direction, were wrapped around the 0.5 inch diameter aluminum rod, which was 15 inches long and centered, lengthwise, on the 46 inch long Unitape bundle. The Unitape-wrap was held together by wrapping with electrical tape, except for 2 inches on either end of the aluminum rod. This two inch gap in tape increased flexibility at either end of the rod so that the Unitape wrap could be folded adjacent to the rod portion. Weights were as follows: aluminum rod 136 gm, Unitape 304 gm, electrical tape 20 gm, total weight 460 gm (aluminum rod 3.57 gm/cm, Unitape bundle 2.60 gm/cm). The pin was threaded through the knuckles (loops) of the hinge, centering the wrapped aluminum rod portion in the knuckles of the hinge. The excess lengths of "pin" on either side of the hinge were folded onto the outside of the two sides of the box adjacent to the front portion containing the hinge. The weights of the containers, 1-3, are set forth in Table 2.

The control containers/boxes, C1-C3, were tested against 1.5, 2.5 and 3.0 ounces of C4, respectively. All of the containers contained the explosion with the bands remaining intact; the plywood inner shell badly splintered.

Containers 1-3 of the present invention (with interrupted/discontinuous bands connected with pins) were tested against 2.0 ounces of C4: Container 1, which utilized the rigid steel pin, contained the explosion. No distortion of the pin was noted. The PVC guide tubes were shattered. Container 2, which utilized the SPECTRA rope, contained the explosion. No rope damage was noted, but again the PVC guide tubes were shattered. Container 3, which utilized the SPECTRA Unitape-wrapped aluminum rod, contained the explosion. The pin was somewhat bent, and the PVC guide tubes were shattered.

It is anticipated that 4 ounces of C4 would cause failure of the control container. Assuming this result, a $C_{50}$ of 3.5 ounces is calculated. The $C_{50}$ for each of the containers with interrupted bands was greater than 2.0 ounces.

EXAMPLE 2

With reference to FIGS. 10A-10E, a hardened aircraft luggage container of the LD3 type was fabricated and tested. The container was a rectangular box having dimensions of, approximately, 77 inches long×56 inches wide×63 inches high. A step, approximately 21 inches long×56 inches wide× 20 inches high, was created at the bottom of one side to facilitate band wrapping. The box was constructed of fiberglass/honeycomb sandwich panels, 0.5 inch thick, with a total of 95 lbs of the panel material used (part N505EC commercially available from Teklam and comprising fiberglass/epoxy skins and NOMEX® honeycomb). The structural fiberglass/honeycomb shell had an opening, 40 inches×40 inches, on the front side. All plates were precut to the side dimensions and assembled in the box using hot-melt thermoplastic glue (#3789 Jet-Melt Adhesive, a commercial product of the 3M Corporation). This shell addresses structural functions of the box since it retains its shape when fully loaded and permits loading and unloading, especially in a user-friendly manner.

The blast containment function is primarily provided by three mutually reinforcing, perpendicular bands of commercially available SPECTRA SHIELD fabric (two continuous bands forming the middle and outer bands, and one interrupted/discontinuous band having a pin joint and forming the inner band). The interrupted band, covering the area of the opening in the shell, was constructed of 14 layers of SPECTRA SHIELD fabric, 54 inches (4.5 ft) wide, thus overlapping the width of the opening in the shell by approximately 7 inches on either side. The hinge connection was created by subdividing the end section (to 6 inches depth) into 2 inch strips, by cutting between the parallel fibers in the hoop direction. These strips were each symetrically folded over from the sides with a double stick tape in the fold to make strips only 1 inch wide. Sections of PVC plastic tubing (1.4 inches inside diameter and 1 inch wide) were fixed inside of each strip, thus creating regular round openings through which the connecting pin (1.375 inches diameter, AERMAT 100 rigid steel pin, 54 in long, weight of 27 lbs, commercially available from Carpenter Technology Corp., Carpenter Steel Division, Reading, Pa. 19612) could be inserted. The interrupted inner band was prepared separately from the box.

With reference to FIGS. 10A and 10C, it can be seen that continuous sub-bands, narrower in width than the box, were formed by directly winding on the box. Each of the sub-bands contained 14 wraps/layers of SPECTRA SHIELD fabric. Sub-bands were wound directly on the box to either side of the access opening in a front, top, back, bottom orientation (see FIG. 10A), after which the interrupted inner band was placed over the box with the pin connection across the middle of the access opening. The pin was horizontal in position. Two additional continuous sub-bands, similar to the others, were formed by directly winding on the box. These sub-bands were also located on either side of the access opening, but were wound in a front, side, back, side orientation (see FIG. 10C). These sub-bands were permanently attached to the box and to themselves via double stick tape (similar to product 465, 2 mil Hitact ADH Transfer Tape, commercially available from the 3M Corp.).

A triangular wedge of 0.125 inch thick aluminum (approximately 21 inches long×56 inches wide×20 inches high, ends closed) was placed in the step with its base located to the exterior prior to wrapping the middle band. This wedge, in conjunction with the stepped box, forms the truncated side of the aircraft LD3 container. The middle band was created by winding SPECTRA SHIELD fabric in the side, top, side, bottom direction, to cover the corresponding (top and bottom) sections of the inner band. The middle band was permanently attached to the box since it does not interfere with the opening of the box. It was attached to the box with double stick tape, similar to that described above.

The outer band was made removable. It was created by winding the full width of SPECTRA SHIELD fabric, 54 inches, for 14 layers in the direction side, front, side, back. The outer band was placed on the container so that it could be moved in the vertical direction. The height of this band causes it to come down past the wedge portion of the truncated side. For commercial application, this band would have height such that it would not extend below the wedge portion of the truncated side.

The integrity of the bands was achieved by periodically placing double-stick tape, similar to that described above, between the layers of SPECTRA SHIELD fabric in the process of winding. Total amount of SPECTRA SHIELD fabric used in the box was 140 lbs.

The container is tested as follows. One pound of C4 is placed within a piece of typical luggage. Other typical luggage pieces, which contain ordinary passenger cothing and toiletry articles, are placed layer by layer within the container until the container is about half full. The luggage containing the C4 charge is then placed at the geometrical center of the container (box). Additional layers of typical luggage pieces are then added until the container is about two-thirds full. The container (box) is then assembled by fastening the inner band with the pin and sliding the outer band into place. The C4 is then detonated. The box is expected to contain the blast successfully with no failure of the fiber bands, including the interrupted inner band (door) utilizing the pin-closure mechanism.

From the foregoing description, one skilled in the art can easily ascertain the essential characteristics of this invention, and without departing from the spirit and scope thereof, can make various changes and modifications of the invention to adapt it to various usages and conditions.

TABLE 1

Control Container Weights (kg)

| Sample | Outer band | Removable middle | Inner band | Plywood shell + 4 plies shield | Total |
|---|---|---|---|---|---|
| C1 | 1.82 | 1.54 | 1.91 | 3.47 | 8.75 |
| C2 | 1.77 | 1.55 | 1.90 | 3.50 | 8.71 |
| C3 | 1.78 | 1.53 | 2.03 | 3.16 | 8.49 |

TABLE 2

Weights of Containers of the Invention (kg)

| Container/ Total Weight | Outer band | Plywood Shell, Inner and Middle Band Assembly (no pin) | Pin |
|---|---|---|---|
| 1/ 10.71 kg | 1.81 kg | 7.25 kg | 1.65 kg |
| 2/ 9.23 kg | 1.72 kg | 7.20 kg | 0.31 kg |
| 3/ 10.00 kg | 1.79 kg | 7.75 kg | 0.46 kg |

We claim:

1. A fence barrier useful to provide protection against threats, said fence barrier comprising a plurality of constraining elements, said constraining elements extending in a generally horizontal direction and being vertically spaced from adjacent constraining elements, said constraining elements comprising at least one fibrous network, the fibers of said fibrous network comprising fibers having a tenacity of at least about 10 g/d and a tensile modulus of at least about 200 g/d, and a plurality of horizontally spaced securing devices that extend in a generally vertical direction, said securing devices being in communication with said plurality of constraining elements to form said barrier.

2. The barrier of claim 1 wherein said fibers have a tenacity of equal to or greater than about 20 g/d and a tensile modulus equal to or greater than about 500 g/d.

3. The barrier of claim 1 wherein said fibers have a tenacity of equal to or greater than about 30 g/d and a tensile modulus equal to or greater than about 1200 g/d.

4. The barrier of claim 3 wherein at least about 50 weight percent of said fibers comprise substantially continuous lengths of fiber extending along the length of said constraining elements.

5. The barrier of claim 4 wherein said fibrous network is in the form of unidirectionally oriented fibers.

6. The barrier of claim 5 wherein said fibrous networks comprise a resin matrix for said unidirectionally oriented fibers.

7. The barrier of claim 6 wherein said fibrous networks comprise a plurality of fibrous sheets that are cross plied.

8. The barrier of clam 1 wherein said fibers comprise fibers selected from the group consisting of extended chain polyolefin fibers, aramid fibers, polybenzoxazole fibers, polybenzothiazole fibers, polyvinyl alcohol fibers, polyacrylonitrile fibers, liquid copolyester fibers, polyamide fibers, glass fibers, carbon fibers, and mixtures thereof.

9. The barrier of claim 1 wherein said fibers comprise extended chain polyethylene fibers.

10. The barrier of claim 1 wherein said constraining elements are in the form of bands having a length and a width, said bands being interrupted across the length thereof to form two ends, said ends comprising at least one integral loop, said integral loops being connected to said securing devices.

11. The barrier of claim 10 wherein said securing devices comprise posts, and said loops extend over said posts.

12. The barrier of claim 1 wherein said securing devices comprise posts.

13. The barrier of claim 12 wherein at least two adjacent posts each secures a plurality of said constraining elements.

* * * * *